US007612790B2

(12) United States Patent
Taniguchi

(10) Patent No.: US 7,612,790 B2
(45) Date of Patent: Nov. 3, 2009

(54) HEATING HEAD FOR ERASING A PRINTED IMAGE ON RE-WRITABLE MEDIA

(76) Inventor: Hideo Taniguchi, 38-16 Kamikatsura, Sannomiya-cho, Nishikyo-ku, Kyoto (JP) 615-8224

( * ) Notice: Subject to any disclaimer, the term of this patent is extended or adjusted under 35 U.S.C. 154(b) by 433 days.

(21) Appl. No.: 11/682,964

(22) Filed: Mar. 7, 2007

(65) Prior Publication Data

US 2007/0146467 A1 Jun. 28, 2007

Related U.S. Application Data

(63) Continuation of application No. 11/061,856, filed on Feb. 18, 2005, now Pat. No. 7,206,009.

(30) Foreign Application Priority Data

Feb. 18, 2004 (JP) ..... 2004-041263
Mar. 29, 2004 (JP) ..... 2004-094440
Apr. 16, 2004 (JP) ..... 2004-122229

(51) Int. Cl.
*B41J 2/335* (2006.01)

(52) U.S. Cl. ..... 347/200

(58) Field of Classification Search ..... 347/171, 347/200

See application file for complete search history.

(56) References Cited

U.S. PATENT DOCUMENTS 4,636,812 A * 1/1987 Bakewell ..... 347/201
5,959,651 A * 9/1999 Nagahata et al. ..... 347/200
7,206,009 B2 * 4/2007 Taniguchi ..... 347/200

FOREIGN PATENT DOCUMENTS

| | | | |
|---|---|---|---|
| JP | 01-156079 | * | 6/1989 |
| JP | 07-068824 | * | 3/1995 |
| JP | 2005-169936 | * | 6/2005 |
| JP | 2005-262631 | * | 9/2005 |

* cited by examiner

*Primary Examiner*—Huan H Tran
(74) *Attorney, Agent, or Firm*—Duft Bornsen & Fishman LLP

(57) ABSTRACT

A heating head which functions as an erase head for quick operation can be turned off while not in use yet it can turn on when it is used (on-demand operation) and operates stably without over-heating even for the long operation, re-writable media record erasing equipment and erasing method. At least one strip of Heating Resistive Element is formed on one side (surface) of Head Substrate lengthwise. The Temperature Measurement Resistive Element is formed on the same side of the Head Substrate surface. The other side is facing the Heat Sink to hold the Head Substrate and the Thermal Resistive Layer is sandwiched. When the re-writable media record is erased, the media is moved across the erase head after the temperature of the temperature measurement resistive element reaches the predetermined level.

9 Claims, 11 Drawing Sheets

Pages 6, 7, 8, 9, 12

Pages 6, 7, 8, 9, 12

1. Head Substrate
2. Heating Resistive Element
3. Temperature Measurement Resistive Element
4. Thermal Resistive Layer
5. Heat Sink
6. Wiring Board Pages 6, 8

Figure 3 Pages 6, 8, 9

12. Insertion Slot
13. (13a, 13b, 13c) Transport Device
14. Discharge Slot
15. Resistive Element Control Device
16. Temperature Measurement Detection Device
17. Heating Temperature Detection Device
18. Transport Control Device Pages 6, 9

Pages 6, 9

Pages 6, 9, 11, 12 16, 18

Pages 6, 10

Pages 6, 10, 11

Figure 9 Pages 6, 11, 12
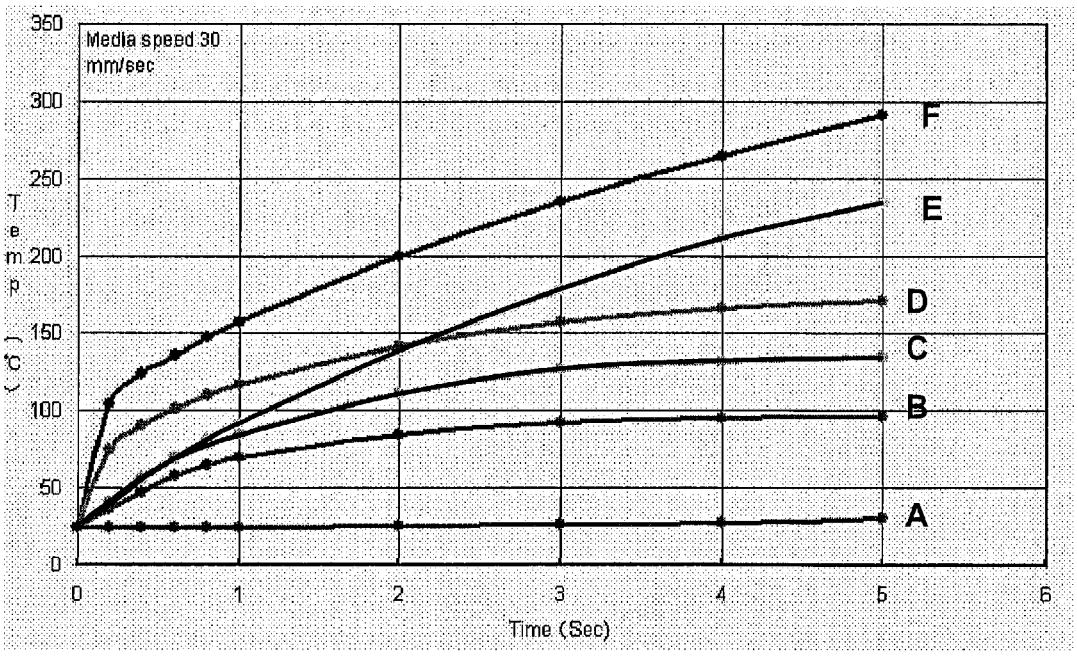

Figure 10 Pages 6, 12, 13, 14, 15
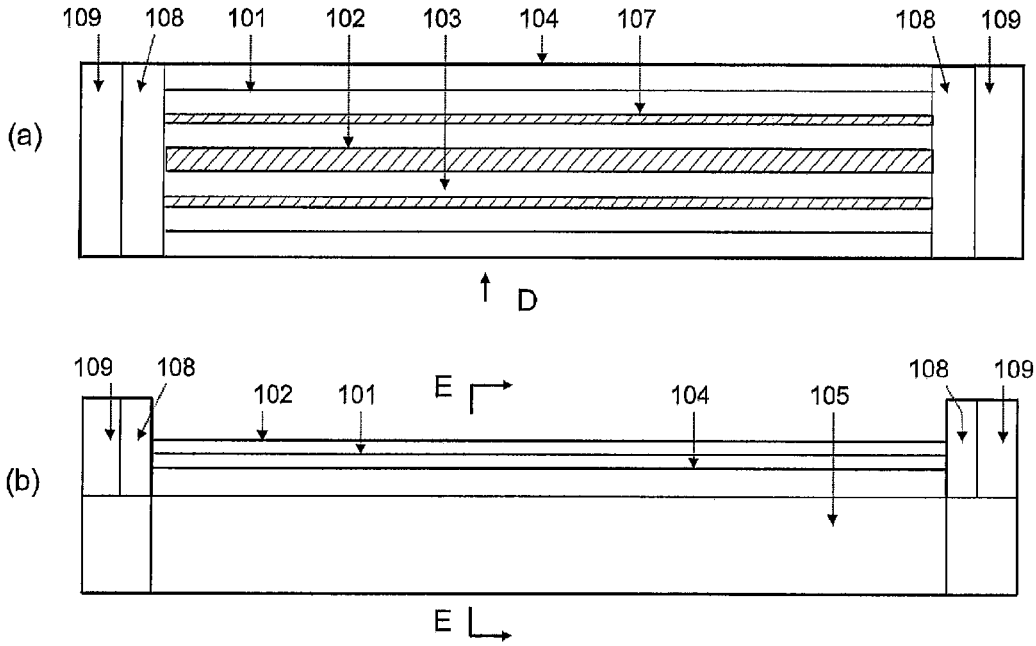
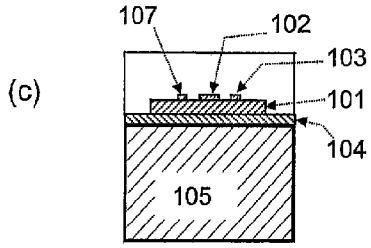
101. Head Substrate
102. Main Heating Resistive Element
103. Temperature Measurement Resistive Element
104. Thermal Resistive Layer
105. Heat Sink
107. Auxiliary Heating Resistive Element
Figure11 (a) Pages 6, 13, 14
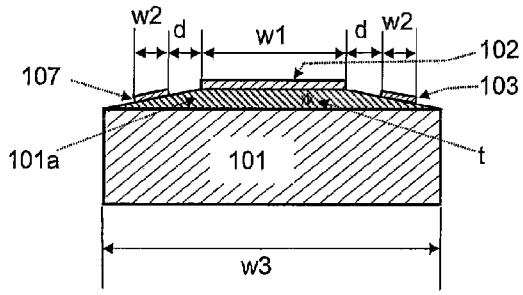
(b)
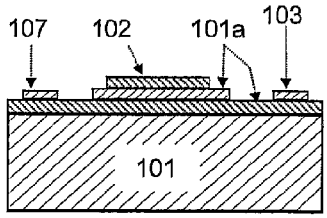

Pages 6, 14, 15

Pages 6, 15

Pages 6, 15, 16

Pages 6, 15, 16, 18

Pages 6, 16

Pages 6, 17

Pages 6, 16

Pages 1, 6

Pages 1, 6

Pages 1, 7

HEATING HEAD FOR ERASING A PRINTED IMAGE ON RE-WRITABLE MEDIA

RELATED APPLICATIONS

This patent is a continuation of, and claims priority to, U.S. patent application Ser. No. 11/061,856 filed 18 Feb. 2005 now U.S. Pat. No. 7,206,009.

FIELD OF THE INVENTION

This invention is related to a heating head for erasing the printed image on material such as reversible direct thermal (re-writable) material coated card which can be imaged by thermal element or for under-coating or over-coating by thermal transfer method. This invention is also related to the heating head which is suitable for on-demand heating which can be used for quick temperature operations, printed image erasing method and related equipment.

BACKGROUND OF THE INVENTION

A re-writable card colors when it is heated above certain temperatures and de-colors when it is re-heated below the coloring temperature. FIG. 19 shows an example of the print media's coloring & de-coloring and the temperature. Since coloring starts at temperatures above T4 (180° C.), characters or images can be printed by heating these records above temperature T4 and cooling quickly down to temperature T1 (80° C.). The printed records can be erased (de-colored) completely by re-heating to temperature range between T2 (120° C.) and T3 (165° C.). In this case, there may be some residual image in the temperature ranged between T1 (80° C.) and T2 (120° C.). If the temperature goes up between T3 (165° C.) and T4 (180° C.), then re-coloring will start. Therefore, it is extremely important to maintain precise temperature control in printing (coloring) and erasing (de-coloring) processes. Additionally, the temperature between the T0 (25° C.) and T1 (80° C.) shown on FIG. 19 is a non-reactive region and there is no change in coloring regardless the way the media is heated or cooled. When the temperature goes beyond T5 (about 200° C.), the heated location becomes degraded and discolored which results in it being impossible to de-color. Those temperatures are for one exemplary recording media and actual temperatures will differ from media to media.

This type of printing and erasing on re-writable cards is done by a re-writable card printer shown in FIG. 20 as an example. More specifically, the process is carried out as follows:

The re-writable card RC is inserted in the card slot 51. The card goes through the print head 53 and the erase head 54 via the carrier route 52 which is made of multiple rollers 52*a*, 52*b* and 52*c*. The re-writable card stops at the hold location P and the switch for the erase head 54 power is turned on to start heating up while standing by. The card movement direction is reversed to go through between the erase head 54 and erase head support platen roller 54*a* for erasing process when the erase head temperature reaches at the predetermined level. The card RC comes out of the slot 51 after the printing is erased. When the card RC needs to be re-printed, it is inserted again in the card slot 51 and it goes between the print head 53 and print head support platen roller 53*a* while the new information is printed by the print head 53. When erasing and printing are performed continuously, it has to be done after the temperature of the card RC is cooled below T1 on the FIG. 19.

The erase head 54 is used for the equipment, for example, is shown graphically as the top and side views on FIG. 21. The heat element 56 is connected to the electric power on the ceramic substrate 55 surface and the thermistor 57 is attached on the back side of the ceramic substrate 55 in order to detect if the temperature reached to erasing temperature or not. The ceramic substrate 55 is held with the holder 58 which is made of the material such as plastic. When the thermistor 57 is placed on the back side of the ceramic substrate 55 to detect if the temperature has reached to the predetermined level or not, the heat element 56 has to generate large amount of heat to accommodate the high heat capacity of the ceramic substrate 55. This will take a long time to make the device erase-ready, 15 seconds for example.

The invention uses a heat element with large temperature coefficient to detect the temperature through the change of current through the heat element. The actual erasing occurs when the card and heat element are in contact, so achieving the erasing temperature at the point is adequate and erasing can be achieved regardless of the temperature of the back side of the ceramic substrate and the response time can be much faster.

SUMMARY OF THE INVENTION

As stated previously, there is a problem of very low efficiency every time a re-writable card is erased by powering the heat element on as it takes about 15 seconds to reach the erasing temperature after the cord is inserted. There are some methods to avoid this inconvenience. One is to pre-heat the erase head at a lower temperature when it is not in use, then increase it to the erasing temperature when it has to be used. The other is to keep the head heat element current on continuously, maintaining the "on state" always so that it is ready for the immediate erasing process. However, constant pre-heating or maintaining the regular erasing temperature all the time will raise problems such as waste of electrical power, shortening the erase head life and safety issue of getting burnt when the hot erase head is touched or fire hazard.

On the other hand, the temperature of the heating element itself will rise in about 2 seconds after the power is turned on and the erasing process can be ready without waiting for the substrate temperature to come up, if the heat element temperature is measured directly which gives a fast feedback as aforementioned. It was found, however, that the process becomes unstable for the first or second erasing after long period of off time.

Moreover, there is a need for certain amount of heat-sinking required when a need for continuous erasing process or thermal transfer process for over-coating is performed in order to avoid over-heating which is the opposite requirement of the previously mentioned minimizing the heat capacity from a quick starting point of view.

The short resistive heat element for a narrow recording media, such as the re-writable card, has less resistance variation in lengthwise orientation. But there may be a case of non-uniform heating when the heat-sinking is uneven because of equipment construction or resistance non-uniformity for a longer heat element length such as A4 size (8.5-inch wide).

The first objective of the invention is to provide the suitable heating head for on-demand (turning on when it is used and turning off when it is not); applications which have quick thermal response can be used continuously without over-heating for usages in erasing devices for re-writable media and also for the under/over-coating usages of the card or sheet through thermal transfer devices. Also, the objective is to provide the re-writable media erasing devices and erasing method.

A second objective of this invention is to provide a heating head which is capable of heating steadily without drastic temperature change for the part where the heating element and the media come in contact for usages in erasing devices for re-writable media and also for the thermal transfer devices. The heating head achieves this through increasing the input power when it is starting the process and compensating it when the temperature changes.

A third objective for the invention is to supply a thermal erase device which is equipped with the safety measures to protect the heat element and erase head as well as to avoid the fire hazard by reducing the input power drastically or cutting off if the heat element when it's temperature goes beyond the pre-determined level regardless whether it is in operation or in stand-by.

The invention's fourth objective is to provide the thermal erase device and erasing method which is capable of erasing the re-writable media without getting into an inadequate situation even if the continuous operation makes the head substrate temperature go up.

The fifth objective of the invention is to provide the heating head which is capable of heating evenly over the entire length of the heat element, a thermal erase device and erasing method.

The sixth objective of the invention is supply the re-writable media erasing method which provides quick temperature rise on start and maintain the stable temperature when it reaches at the predetermined level.

While checking the temperature of the heating element and moving the re-writable media into easing position to erase the printing, there was a case of inadequate erasing during the first couple of times when starting cold. After studying the cause for the phenomena, it was found that the problem was caused due to the sudden temperature drop as the heating element heat capacity is small and the temperature goes down as it touches the re-writable media. The inventor discovered that a complete erase is possible from the first run even after long off time if the head substrate surface is at the determined temperature which prevents the heat element sudden temperature drop. Moreover, he found that it is possible to control the heat loss from the head substrate by sandwiching the thermal resistance layer between the head substrate and heat-sink which will make the stable temperature maintenance possible even if the head substrate surface temperature goes up in short time and the operation continues for a long time.

As a result, it was found that it was not necessary to raise the temperature of the back side of the head substrate if the head substrate surface temperature reaches the predetermined level in order to erase the image on the re-writable media adequately and the heat element temperature does not drop suddenly when the media is inserted. Even with the on demand operation, it was found that waiting time is only about 2 seconds to be able to erase.

The heating head of this invention has the head substrate having a first side with at least one strip of electrical resistive element for heating oriented lengthwise and another electrical resistive element for temperature measurement, while the other side is facing a heat sink to hold the head substrate and the thermal resistive layer and a sandwiched orientation.

The aforementioned heating resistive element has a positive temperature coefficient which increases electrical resistance by 1000-3500 ppm/° C. The temperature of the heating resistive can be measured by connecting a resistor of smaller temperature coefficient value than the said resistive element in series with this resistive element. This enables the heating resistive element temperature to be controlled accurately whether it has been in use continuously or sporadic use.

The aforementioned resistive element for temperature measurement is coated on one side of the said head substrate with positive or negative temperature coefficient material of 1000-3500 ppm/° C. and the head substrate surface temperature can be detected accurately by connecting the resistor of smaller temperature coefficient value than the said resistive element for temperature measurement in series with this resistive element and checking the resistance change of temperature measurement resistive element.

This heating head is equipped with a heating resistive element and a resistive element for temperature measurement, so not only the heating resistive element temperature but also the head substrate surface temperature can be detected. That is to say the resistive element for temperature measurement is made with the a paste to form a thin coat on the head substrate surface and it is about the same temperature as the that of substrate surface and the head substrate surface temperature can be detected by putting through a small amount of current so that the temperature measurement resistive element will not generate heat. As a result, both the heating resistive element and head substrate temperatures can be measured and temperature control is possible through the two values.

Additionally, this heating head will not over-heat even if it is operated continuously for a long time as a thermal resistive layer is built-in between the head substrate and heat-sink which enables fast temperature rise of head substrate of small heat capacity while temperature increase due to long period operation is held down as the layer provides thermal path to the heat-sink. More specifically, although the head substrate temperature reaches the predetermined level in a short period, the temperature can be stably kept at the level for a long continuous operation. The relation of thermal conductivity coefficients is, for example, greater than 80 W/m·K for the metal heat-sink, lower than 0.3 W/m·K for thermal resistance layer and the head substrate is in between the two.

The thermal resistance layer is picked based on the heating head's usage objective. For example, comparatively large thermal conductivity coefficient layer is used for continuous duty, while small coefficient material is used for mainly sporadic short time operation. When the largest thermal resistance coefficient is required, it can be left as the air gap and it acts as the "thermal resistance layer". If the erase head and print head are placed in close proximity and it requires printing right after erasing, layer with small thermal resistance value can be used as it will lower the temperature quickly.

The erasing equipment designed for re-writable media in accordance with features and aspects hereof may include the following:

- The heating head which has a strip-shaped resistive element for heating located on one side of the head substrate, the resistive element for temperature measurement on the same side of the head substrate and the heatsink which is attached on the other side of the head substrate.
- The means to detect the temperature for measurement purposes by the aforementioned resistive element for temperature measurement.
- The transport device for the re-writable media to go from the insertion slot to discharge slot through the aforementioned resistive element for heating.
- The means to control to turn the voltage on the resistive element when the re-writable media comes to the media holding position and to turn it off when the media passes through the resistive heat element or when the predetermined time elapses from the media transport starting time.

The transport control means to start moving the re-writable media when the temperature of the aforementioned resistive element for temperature measurement reaches the predetermined level by the measurement means with the aforementioned transport device so that the media is discharged or stop the transport device when predetermined time is elapsed.

Holding the re-writable card can be done at the insertion slot, near the erase head within the erasing equipment or in contact with the erase head. Detection of the re-writable card reaching the media holding position can be done by a sensor or predetermined time after the card goes through a sensed at the insertion slot. Also, the detection of the media passed through the heating element or media discharge can be achieved by positioning a sensor near the heating element or discharge slot, or pre-setting a certain amount of time after the media starting to move.

Having the temperature detecting means for the aforementioned resistive element for heating makes it possible to erase at an accurate temperature even if the temperature of the resistive element for heating and the temperature of resistive element for temperature measurement becomes relatively close due to continuous operation. That is to say that the heat from the resistive element for heating moves to the head substrate and reaches to the temperature measurement resistive element when the substrate temperature is low in the beginning of an operation (The temperature gradient of resistive element for heating at a given temperature is set higher then the that of temperature measuring resistive element), but there may be a delay for the heating element to reach the predetermined temperature if the head substrate temperature becomes higher. However, it is possible to control the starting of re-writable media by heat element temperature by detecting the heat element temperature.

It is possible to maintain the temperature of resistive element for heating very stably regardless of usage situation by establishing the aforementioned input control of the heat element to prevent excessive heating of the heat element.

The aforementioned heating element temperature detection means turns off or reduces the input to the heating element if its temperature becomes higher than the predetermined level. This will prevent overheating of the erase head or fire hazard even if the head is energized without the re-writable media, incorrect resistance value of erase head or other malfunction and this is desirable from a safety view point.

The re-writable media erasing method of this invention is to place a resistive element for heating on one side of head substrate and the generated heat form the element to erase the image. On the same side of the substrate, a separate resistive element is set up for temperature measurement. It has the characteristics of erasing the image on the re-writable media by transferring the media to the aforementioned heating element when the detected temperature of the resistive element for temperature measurement reaches the predetermined level.

It is possible to erase completely even if the various conditions are changed while erasing by setting up the heating temperature within the range of the erasing temperature of the said re-writable media according to the erasing speed, erasing frequency, ambient temperature or type of re-writable media. In general, it is desirable to heat in the middle of the media's erasing temperature range as a small temperature fluctuation will not affect the erasing process. For continuous operation or frequent usage, it is better to set the temperature at a lower end of the range of the re-writable media as the head substrate has tendency to accumulate heat and it helps to reduce the power consumption. In other word, the most suitable temperature can be set according to the usage purpose and re-writable media type. There is a temperature difference between the temperature measurement resistive element (head substrate surface) and the heating element, but usually the difference is about constant and the predetermined temperature for the measurement resistor element is established with the difference consideration.

It is possible to erase accurately, very cleanly and without wasting the electrical power by turning on the resistive element for heating and temperature measurement when the aforementioned re-writable media reaches to erasing devices media holding position. When the temperature measurement resistive element temperature reaches the pre-determined level, the re-writable media is moved via the transport device through the heating element. When the re-writable media moves off the heating element or after the predetermined time since the starting the transport, the power to the heating element and temperature measurement resistor is turned off.

By detecting the temperature of the aforementioned heating element, driving the transport device when the temperature reaches to the predetermined level for heat element and temperature measurement resistive element, very accurate erasing is possible without causing the partial erasing even if the temperature relationship between the head substrate and heat element changes greatly due to continuous operation.

With this re-writable media erasing method and device, there is no drastic temperature drop of heating element when the re-writable media and the heating element touch each other as the erase head and re-writable media come in contact after the temperature of the measurement resistive element which is same as the head substrate temperature reaches the predetermined level, since the temperature is maintained with the head substrate surface as well as the heating element, i.e. increased heat capacity. This make is possible to obtain complete erasing result. Furthermore, the erasing operation can be started very quickly unlike the unit with temperature detection done on the back side of head substrate which requires waiting for the whole head substrate to reach the desired temperature. As a result, the resistive element is turned off while not in use and it is turned on only when erasing operation is needed. On-demand operation is done very efficiently with no wasted power while not in use, preventing the erase head degradation & wear and also it is safe.

Also, since the erasing process starts after the head substrate surface temperature is detected, very accurate erasing is possible even the ambient temperature is low or high. In case there is a change in temperature relationship between the heating element and head substrate surface because of erasing speed, erasing frequency, ambient temperature conditions or re-writable media type, adjustment of accurate temperature set-up can be done by changing the transporting start predetermined temperature.

The inventor found the following as a result of study to increase the on-demand erasing process speed. If high initial current (voltage) is applied to the heating resistor element to raise the temperature and the current (voltage) is reduced once the predetermined level is reached, then re-printing occurs due to slow thermal response and over-heating. If the input is reduced too low in order to reduce the temperature, then the temperature goes down too low resulting incomplete and unstable erasing. On the other hand, if the resistive element for heating is made into two parts, the main heating element and auxiliary heating element, then he found that it is easier to obtain a quick temperature rise in starting and maintain the temperature once it reaches to the predetermined level when the following driving method is used. The input power, for example, of main heating element is kept about 90% and keeping it constant while the input of auxiliary heating element is kept on at about 20% until the temperature reaches the desirable level and it is turned off. The auxiliary heating element is turned on when the temperature goes down below the predetermined level.

More specifically, the heating head of this invention has the head substrate, at least one stripe shaped resistor as the main heating element in the lengthwise direction on one side of the said substrate, an aforementioned auxiliary resistive element for heating along side with the main heating element on the same side of the substrate, the previously mentioned resistive element for temperature measurement on the same side of the substrate, the heat sink which holds the opposite side of the said head substrate and the thermal resistive layer placed between the said heat sink and aforementioned head substrate.

The aforementioned resistive element for auxiliary heating and the resistive element for temperature measurement are placed along the main heating resistive element. The electrodes of auxiliary heating element and temperature measurement element are formed such that they are divided into more than two sections lengthwise along the main heating element and heating and/or measuring will be possible. Therefore, if there is a variation on the resistance value of the main heating element or temperature difference lengthwise due to effect of device location, the temperature variation can be compensated with the auxiliary heating element when it is detected.

The main resistive element for heating, auxiliary heating element and resistive element for temperature measurement are placed on the aforementioned head substrate which is in contact with the insulation layer. The cross-section in the insulation layer thickness-wise forms the "trapezoidal" shape. The main heating resistive element is placed on the upper surface of the "trapezoid", while the auxiliary heating element and resistive element for temperature measurement are located on the side surface of the "trapezoid". This makes the only contact with high pressure to the re-writable media be the main heating element and the auxiliary heating element or temperature measuring element will not be pressed against the media. Movement of the re-writable media, therefore, will be smooth. The terminology "trapezoidal" shape used here is not true sense of trapezoid, but it means the shape which has the center portion being higher than the both ends and a shape like convex is included.

This heating head is capable of quick start and stable temperature operation for re-writable erasing as the auxiliary heating element is placed adjacent to the main heating element and it can be turned on when the on-demand heating is required to reach the required temperature very quickly. Once the temperature is achieved, then the input to the auxiliary heating element can be turned off or reduced greatly. Additionally, it is easy to maintain the constant temperature by detecting the head substrate temperature near the main heating resistive element and controlling the auxiliary heating element if the temperature goes down. Also, by putting the electrodes where the temperature measurement resistive element and auxiliary heating element are divided in lengthwise, the temperature variation can be compensated.

The re-writable media record erasing equipment of this invention has the heating head that has the head substrate with one side with a strip of main heating resistive element, auxiliary heating resistive element and temperature measurement resistive element, while the other side is facing the heat sink to hold the said head substrate, aforementioned temperature measurement detection device which detect the temperature of the temperature measurement resistive element and transport device for the re-writable media from the insertion slot to discharge slot via the aforementioned heating resistive element.

The aforementioned auxiliary resistive element and resistive element for temperature measurement are placed along the main heating resistive element. They are divided into more than 2 sections in corresponding manner so that heating and measuring can be done in section. By measuring the temperature distribution and controlling means of auxiliary heating element input, the auxiliary heating resistive element can compensate if there is a temperature variation in the lengthwise direction for some reason.

The record erasing method of this invention has the following characteristics of erasing the re-writable media record: Erasing of the re-writable media record is done with the heat from the main heating resistive element which is set up on one side of the head substrate. The auxiliary heating resistive element and temperature measurement resistive element are set up on the same side of the head substrate but separately from the main heating resistive element. The temperature of the temperature measurement resistive element is detected. When the detected temperature reaches the predetermined level, the aforementioned media is sent to the main heating resistive element for erasing.

In practice, both the main heating resistive element and the auxiliary heating element heat until the predetermined temperature level are achieved. When the predetermined temperature is detected by the temperature measurement resistive element, the auxiliary heating element input is turned off or reduced. If the temperature goes below the predetermined level, then the auxiliary heating resistive element is turned on to maintain the temperature. So it is possible to start quickly and maintain the stable temperature of the main heating resistive element. The predetermined temperature to turn off or reduce the auxiliary heating element can be the same as the temperature to start transporting the re-writable media to the main heating resistive element or it can be a different temperature. Additionally, the temperature to start re-heating by the auxiliary heating element can be the same temperature which the auxiliary heating element is turned off or it can be set to a different temperature.

The aforementioned auxiliary heating resistive element and temperature measurement resistive element along the main heating resistive element lengthwise are divided into more than 2 sections. Even if the main heating resistive element becomes long, uniform heating process is possible by maintaining the temperature constant in lengthwise since the sectionalized temperature measurement resistive element can detect the temperature distribution and the corresponding auxiliary heating element can make the distribution uniform. The division means that the forming of electrode enables the sectional temperature measurement or power application is possible but the resistive element itself does not have to be divided.

Using the re-writable media erasing method and equipment, it is possible to go from inserting the card to start heat-up to discharging the card in mere 1.8 seconds in on-demand process without re-printing due to over-heating or residual image. The relation between the main heating resistive element and the auxiliary heating resistive element can be many, but one example will be to apply about 90% of normal input to the main heating resistive element and 20% to the auxiliary heating element. When the process is starting, turn the both elements on. Once the predetermined temperature is achieved, then turn off the auxiliary element. By this method, quick start is possible and preventing over-heating with easy temperature control. Moreover, the input to the main heating element which is in contact with the re-writable media is constant which makes the media heating very stable.

BRIEF DESCRIPTION OF DRAWINGS

FIG. 9 shows an example of temperature characteristics of various parts of the heating head shown on FIG. 1.

FIG. 10 is the top and the side views which show the second implementation figuration of the heating head of this invention.

FIG. 11 is the expanded cross-section view explanation of resistive element part of FIG. 10.

DETAILED DESCRIPTION OF THE INVENTION

The heating head of this invention, the re-writable media erasing device and the erasing method are explained as follows with referenced figures.

Figure 1:
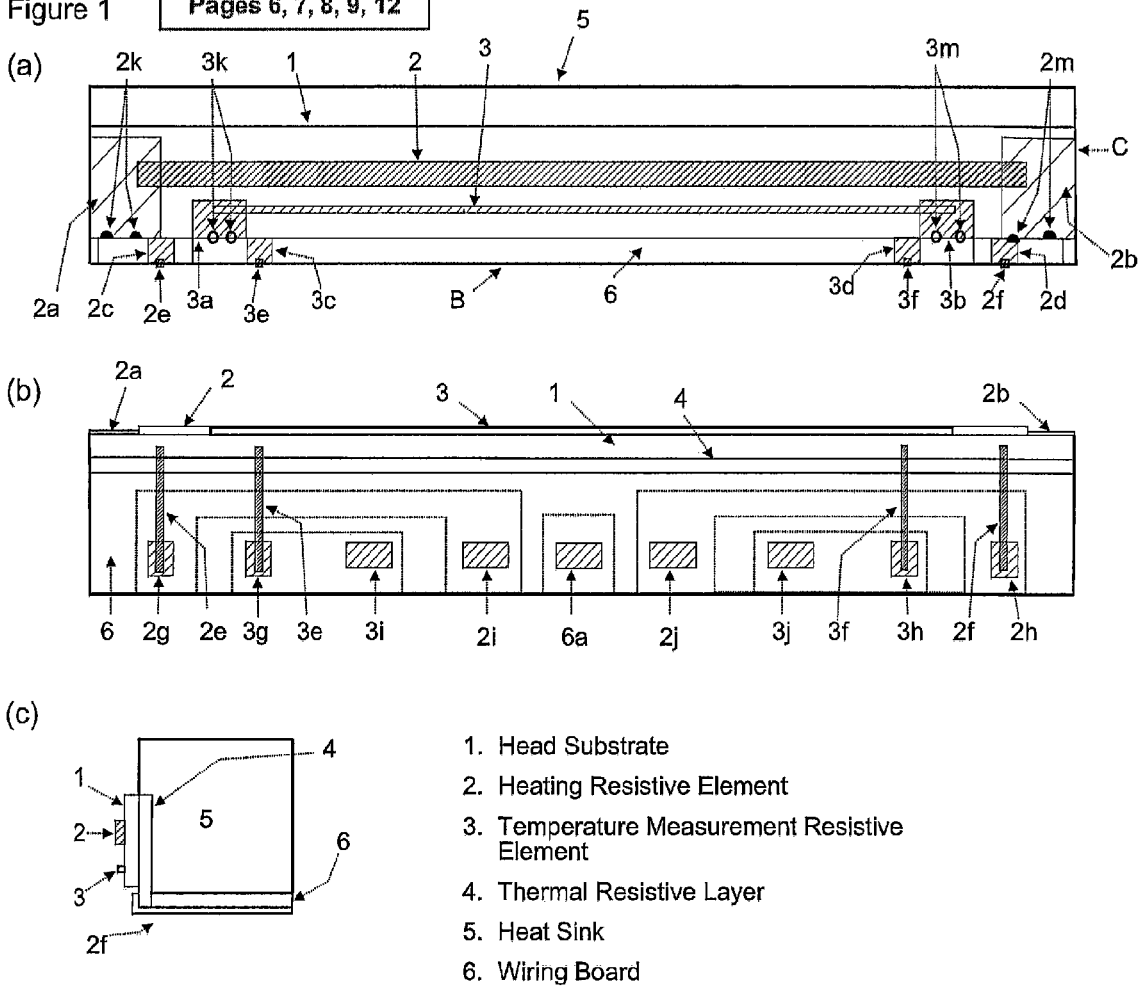
FIG. 1 is the top and the side views which show the first implementation figuration of the heating head of this invention.

The heating head of this invention with the first implementation figuration is shown on FIG. 1. As shown on top and side views {(a), (b) and (c) views}, at least one strip of Heating Resistive Element 2 and Temperature Measurement Resistive Element 3 are placed on one side (surface) of the Head Substrate 1 which is rectangular shape. The Heat Sink 5 holds the Head Substrate 1 from the opposite side (back side) of the Head Substrate 1 and there is the Thermal Resistance Layer 4 in between.

The Head Substrate 1 is made of material with somewhat good thermal conductivity such as 0.5 to 30 W/m·K, having thermo-stability at the heating temperature usage conditions and is electrically isolative on the side which the heating resistive element is placed. For example ceramics like alumina (thermal conductivity: 21 W/m·K), quartz glass (thermal conductivity: 1.4 W/m·K) and glass (thermal conductivity: 0.8 W/m·K) can be used with rectangular shaped plate of about 50 mm long, about 5 mm wide and about 0.6 mm thick. There is a danger of over-heating if the thermal conductivity is too low when the device is used continuously and heat loss is excessive if the thermal conductivity is too high. From this point of view, resin-related material, metal such as stainless steel plate whose surface is treated to be electrical insulation and glass-related material can be used also. The alumina substrate with over-coating glass layer, though it is not shown on the figure, (thermal conductivity: 0.8 W/m·K) of 0.08 mm is used for the Head Substrate 1 figuration implementation.

The Heating Resistive Element 2 is formed by applying the paste-like mixture of substances such as Silver (Agiii), Palladium (Pd) and solid insulation like glass in powder form onto the substrate and fired in the furnace. Additionally, such material as RuO2 can be added in the process. The sheet resistance for the fired Ag—Pd alloy is 100 mOhms/Sq to 200 mOhms/Sq (it changes based on the amount of solid insulation powder), but the resistance value and temperature coefficient can be changed with the mixture rate of the two. When it is used as the conductor (electrode), the resistance can be lowered with more Ag. The size is, for example, width about 2 mm and thickness about 10 micrometers. The length is about 45 mm on the Substrate 1 in the widthwise with linear shape and both ends are overlapping on the pair of Electrodes 2*a* and 2*b*. Resistance value is about 8 Ohms and resistor temperature coefficient is about 1500 ppm/° C. (i.e. when the temperature changes 100° C., then the resistance value changes 15%). The heating characteristics of the Heating Resistive Element 2 can be changed to any values, but it is desirable for this application to have high positive values, especially the material which gives 1000 to 3500 ppm/° C. is easier to control.

Positive and higher resistor temperature coefficient gives larger resistance value increase for the temperature rise which makes the detection of actual heating temperature easier and more accurate by measuring the resistance deviation of heated state from the standard resistance value. This makes the correction to the desired temperature easier by adjusting the applied voltage or duty cycle of applied pulse if needed. The positive resistor temperature coefficient prevents excessive heating by malfunctions such as thermal runaway as the resistance goes up as the temperature increases. When the resistance increases, the current decreases and the saturation temperature is reached faster which results in superior temperature stability at higher temperature. The width of the Heating Resistive Element 2 is not limited to the aforementioned example and it can be set up according to the application. Several of them can be placed in parallel.

Both ends of the Heating Resistive Element 2 are made into the Electrode 2*a* and 2*b* by screen printing the good conductor, for example, silver-palladium alloy with reduced palladium ratio or Ag—Pt alloy. The Electrode 2*a* and 2*b* are connected to the External Connecting Terminal 2*i* and 2*j* on the Wiring Board 6, through the Intermediary Conductor 2*c* and 2*d* on the Thermal Resistive Layer 4 and via Electrode 2*g* and 2*h* of the Wiring Board and Connecting Wire 2*e* and 2*f*. The power is applied to the Heating Resistive Element 2 via the External Connecting Terminal 2*i* and 2*j*.

The Temperature Measurement Resistive Element 3 can be made of the same material as the Heating Resistive Element 2, but it is desirable to have the highest absolute value (%) of temperature coefficient possible. The Temperature Measurement Resistive Element 3 is for measuring the temperature of Head Substrate 1 and not for heating. It is about 0.5 mm wide and 33 mm long with 12 Ohms, and the applied voltage is about 5 V so that it does not generate heat. Since the Temperature Measurement Resistive Element 3 is a thin layer on the Head Substrate 1, their temperatures are about the same. Therefore, the surface temperature of the Head Substrate 1 can be estimated by measuring the temperature of the Temperature Measurement Resistive Element 3. The larger temperature coefficient will make the measurement error smaller as the temperature is measured by detecting the voltage change across the Temperature Measurement Resistive Element 3. The temperature coefficient can be positive or negative for this application.

If the material of the Temperature Measurement Resistive Element 3 and the Heating Resistive Element 2 is the same, they can be manufactured at the same time if they are formed with method like screen-printing and it will be desirable. If higher temperature measurement accuracy is required, however, material with different mixture ratio of Ag and Pd or completely different material with larger temperature coefficient can be used.

Though it is not shown on the figure, a protective layer of such material as glass can be put over the Temperature Measurement Resistive Element 3 and the Heating Resistive Element 2 in order to prevent abrasion and also short-circuit due to adhesion of foreign object. It is not shown on the figure, a glass layer of 0.01 mm (thermal conductivity: 1 W/m·K) is used for the actual implementation figuration.

The back side of Head Substrate 1 is attached to the Heat Sink 5 with Thermal Resistive Layer 4 sandwiched. The Thermal Resistive Layer 4, having lower thermal conductivity coefficient than the Head Substrate 1, helps to reach to the erasing temperature as soon as the Heating Resistive Element 2 on the Head Substrate 1 is energized by not leaking the heat generated. As it was discussed previously, there is a case when erasing is inadequate when the Head Substrate 1 is too low even if the Heating Resistive Element 2 is at the predetermined temperature. It was found by the inventor that temperature relationship between Heating Resistive Element 2 and Head Substrate 1 can be maintained by establishing the Thermal Resistive Layer 4 and controlling the thermal conductivity. The Thermal Resistive Layer 4 should have lower thermal conductivity than the Head Substrate, i.e. less than 0.3 W/m·K, and 0.5 mm thick glass-epoxy board (thermal conductivity: 0.2 W/m·K), for example, can be used. The material and thickness for the Thermal Resistive Layer 4 should be selected so that the temperature relationship between the Heating Resistive Element 2 and the surface temperature of the Head Substrate 1 becomes stable at the shortest time, yet cools off as fast as possible when the power to the resistive element is turned off.

The material used for the Heat Sink 5 should have large thermal conductivity such as aluminum plate (thermal conductivity: 221 W/m·K) and steel plate (thermal conductivity: 83 W/m·K), although it does not have to be limited to metal as long as it can hold the Head Substrate 1 securely and it can maintain the stable temperature even if it is energized continuously. The Heat Sink 5 implemented in conjunction with the Head Substrate 1 has the configuration of about 50 mm long, 7 mm wide and 7 mm thick.

The side of the Heat Sink 5 has the Wiring Board 6 made of printed circuit board as shown on FIGS. 1 (*b*) and (*c*).

The circuit wiring is covered with the resin coating to establish insulation layer. The Heating Resistive Element 2 is powered by the external power supply which is not shown via Electrode 2*g* and 2*h* through the External Terminal 2*i* and 2*j* on the Wiring Board 6 which are exposed, and as described previously, they are connected to the Electrode 2*a* and 2*b* of the Heating Resistive Element 2. The Temperature Measurement Resistive Element 3 is connected in a similar manner, Electrode 3*g* and 3*h*, then the External Terminal 3*i* and 3*j* which are exposed on the Wiring Board 6, connected with Intermediary Conductor 3*c* and 3*d* on the Thermal Resistive Layer 4 to Electrode 3*g* and 3*h* and Connection Wire 3*e* and 3*f*. The external power supply which is not shown on the figure is connected to the External terminal 3*i* and 3*j* to supply voltage to the Temperature Measurement Resistive Element 3. Additionally, 6*a* is the Thermistor Terminal in case a thermistor is attached on the back side of the head substrate for over-heating protection as redundant safety measures.

Figure 2:
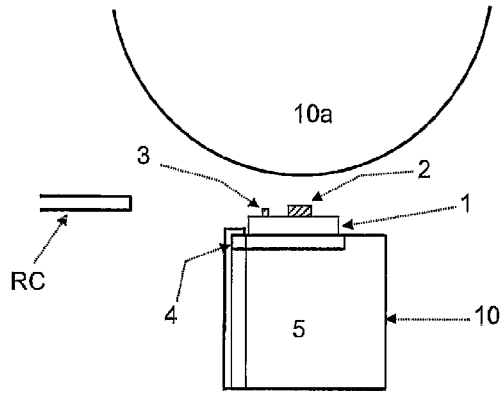
FIG. 2 is an approximate explanation diagram when the heating head shown in FIG. 1 is used for erasing.

The FIG. 2 shows the heating head used as the erase head for erasing the record on the re-writable media. While the temperature of the Heating Resistive Element 2 temperature on the Erase Head 10 is elevated to the predetermined level, the re-writable card RC is moved as the Platen Roller 10*a* rotates, resulting in the card RC to be pressed against the Heating Resistive Element 2. The printed image is erased as the temperature of the image portion of the card RC goes up.

The heating head of the first implementation figuration can obtain the predetermined temperature rise of heating element and the surface of the Head Substrate 1 as soon as the power is applied to the Heating Resistive Element 2. This is because the material for construction of the Head Substrate 1 which the Heating Resistive Element 2 and the Temperature Measurement Resistive Element 3 are located has certain amount of thermal conductivity, while the back side is attached to the heat sink which has the thermal conductivity ten times higher than the head substrate and the Thermal Resistive Layer 4 in between the two has the thermal conductivity which is 1/100 of the head substrate. Since the heat sink which is on contact with the thermal resistive layer has a very good thermal conductivity, heat is dissipated through the thin thermal resistive layer when the head is used continuously for a long time. As a result, the temperature goes up to the predetermined level in a short time while it does not over-heat even the unit is used continuously. Therefore, this makes an extremely thermally stable heating head under any usage conditions for re-writable media erasing device which may be used intermittently and for heating head for thermal transfer unit of under-coating and over-coating.

Figure 3:
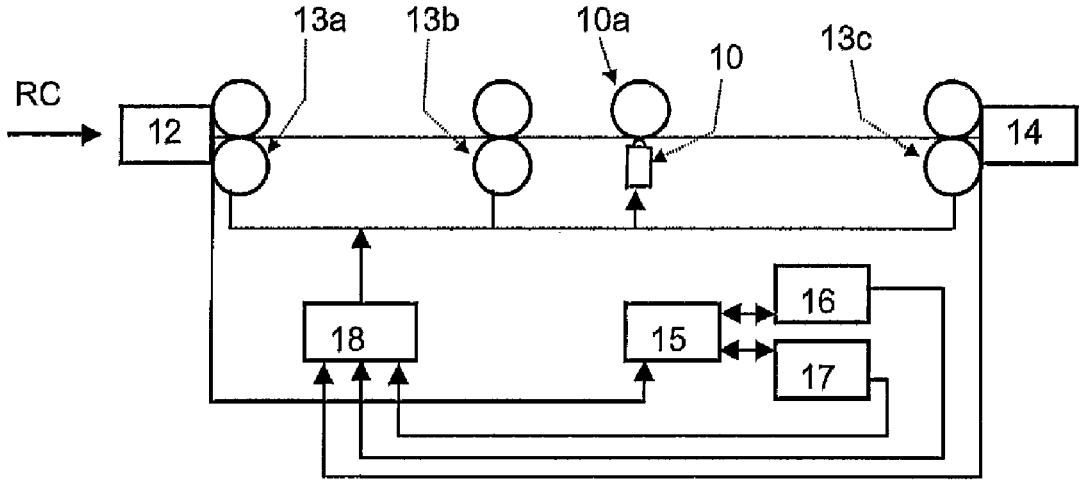
FIG. 3 is an outline block diagram of the erasing equipment by this invention equipped with the heating head configuration shown on FIG. 1.

The next is the explanation of the re-writable media easing device which uses the invented erase head described previously as the first implementation figuration and its erasing method. The FIG. 3 is the block diagram of an example of the erasing device for the re-writable media. The characteristics of erasing method is to use the Erase Head 10 whose configuration is shown on FIG. 1 and to detect the temperature of the measurement resistive element, i.e. head substrate surface temperature. When the temperature reaches the predetermined level, then the re-writable media card RC is transported onto the heating resistive element for erasing.

Figure 4:
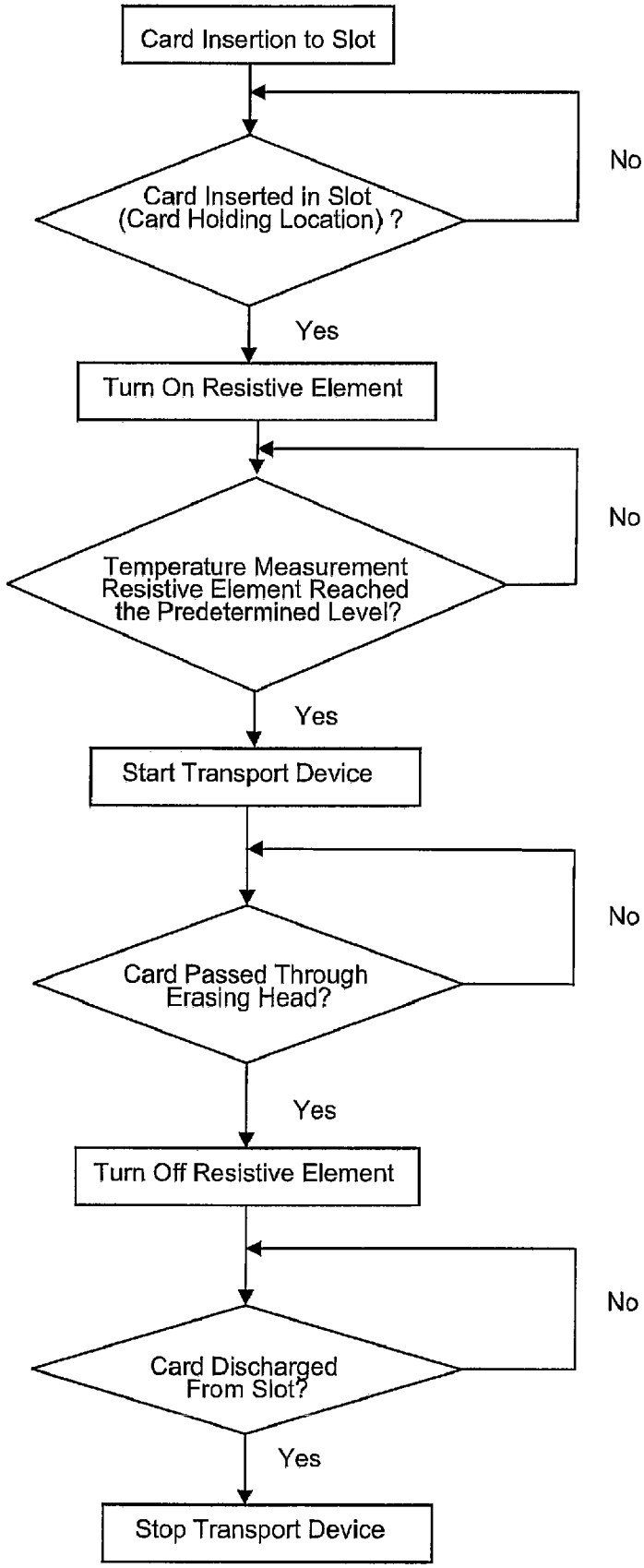
FIG. 4 is the flow chart of implementation of erasing method by this invention using the heating head configuration shown on FIG. 1.
Figure 6:
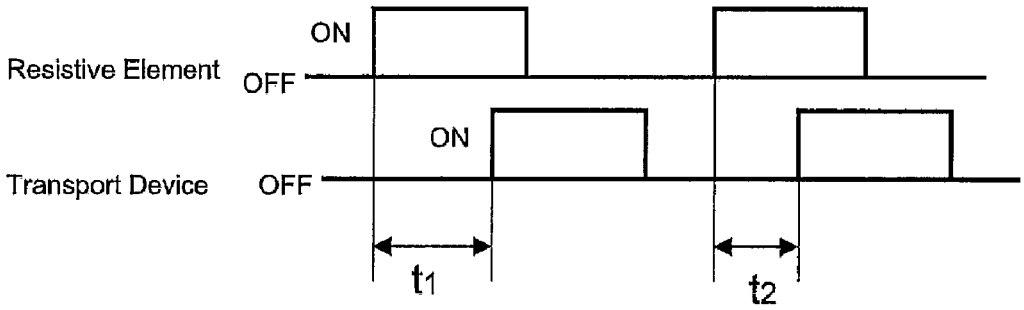
FIG. 6 is the timing chart for turning on the resistive element and transport device drive shown on FIG. 3.

More specifically, the flow chart is shown on FIG. 4. When the Card RC is inserted to the media holding location, Insertion Slot 12 of the erasing device, for example, the power (24 V for example) to the heating resistive element and temperature measurement resistive element is turned on by the Resistive Element Control Device 15. The temperature of the measurement resistive element is detected by the Temperature Measurement Device 16. When the temperature reaches the predetermined level (130° C. for example), the Card RC is moved by the Transport Device 13 (13*a*, 13*b* and 13*c*) with the Transport Control Device 18. The power to the heating resistive element and temperature measurement resistive element is turned off when the Card RC goes on and through the Erase Head 10. When the Card RC is discharged from the Discharge Slot 14 of the erase device, the Transport Device 13 is halted by the Transport Control Device 18 through detection sensor (not shown) or time control from the transport starting time. The timing chart of the Resistive Element Control Device 15 and Transport Control Device 18 is shown on FIG. 6. FIG. 6 shows the example of two cards processed in succession.

The speed of Transport Device 13 is about 30 mm/sec for example, but it can be increased or decreased based on the application. The control of transport device can be done with preset time interval rather than controlling by the card position. For example, the resistive elements power can be turned off after 2.5 seconds (movement of 75 mm) from starting signal by the Temperature Measurement Device 16 to transport device and the transport device can be stopped after 3 seconds (movement of 90 mm) once the transport speed is recognized. The time can be set based on the size of the equipment and the media holding location.

Figure 5:
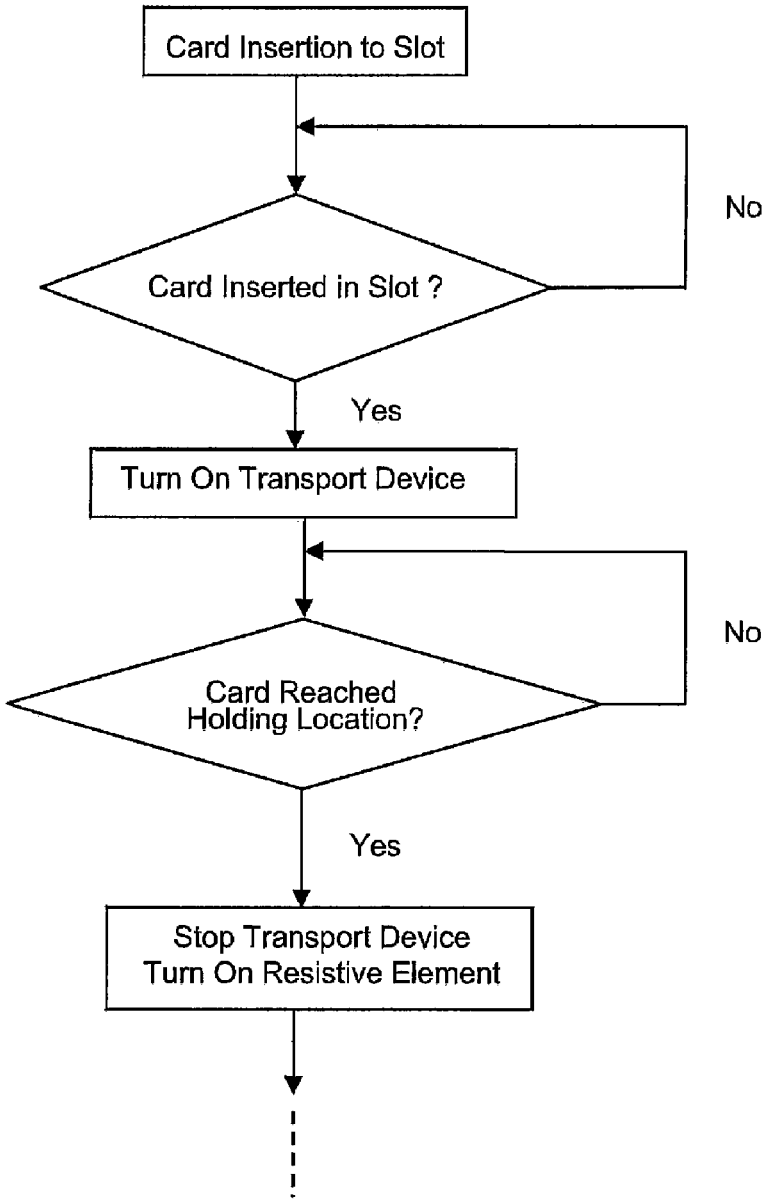
FIG. 5 is the flow chart of implementation variation of erasing method by this invention using the heating head configuration shown on FIG. 1.

The example on FIG. 4 is based on the media holding location being at the card insertion slot, but it can be at the various places within the erasing device such as near or in the touching distance from the erasing head. In this case, the power-on is controlled to the aforementioned resistive elements after the card is sent to the media holding location automatically or manually when the card is inserted to the slot. FIG. 5 is the flow chart of an example. In this example, the card is transported to the media holding location by the Transport Device 13 when the card is inserted to the slot and it is detected. The power to the heating resistive element and temperature measurement resistive element is turned on by the resistive element control device and the transport device is stopped when the card arrives at the media holding location is detected by the sensor or by the time control means. The operations following to the steps are the same as what are described on FIG. 4.

The block diagram shown in FIG. 3 is constituted so that a series of processes shown in FIG. 4 can be performed. The Insertion Slot 12 is made so that the Card RC can be inserted and it acts as the media holding location where the card insertion sensor is place (although it is not shown). The signal from the sensor when the card is inserted is sent to the Resistive Element Control Device 15. The inserted Card RC is transported via Transport Device 13 while the Card RC is sandwiched with the Transport Rollers 13*a*, 13*b* and 13*c* to the Erase Head 10 and the Discharge Slot 14. The rotation of the Transport Rollers 13*a*, 13*b* and 13*c* is controlled by the Transport Control Device 18 and the Card RC is transported according to the predetermined timing. The FIG. 3 shows the Insertion Slot 12 and Discharge Slot 14 are in a separate location, but the Insertion Slot 12 and Discharge Slot 14 can be at the same place by reversing the Card RC's direction during the process. Also, as stated before, the media holding location can be set up in a different place from the Insertion Slot 12.

Figure 7:
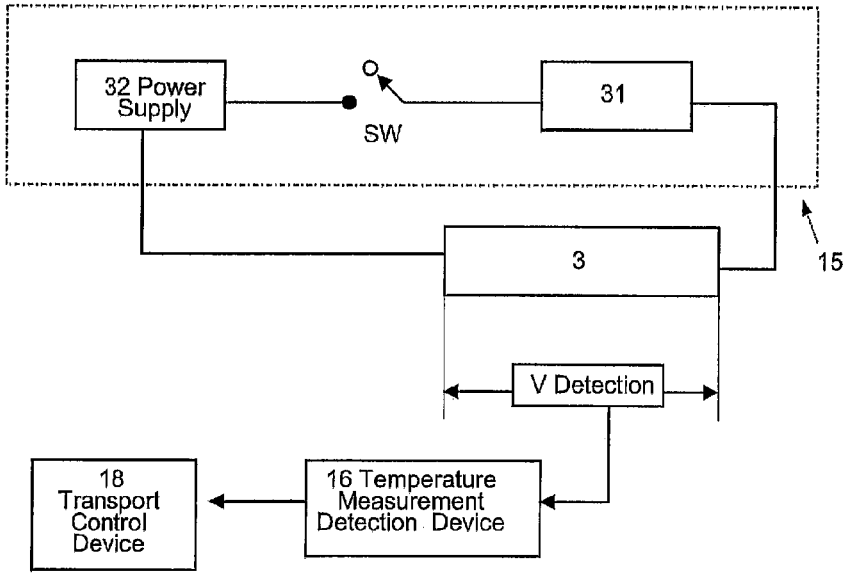
FIG. 7 is an example of block diagram for resistive element control means and the temperature measurement method shown on FIG. 3.
Figure 8:
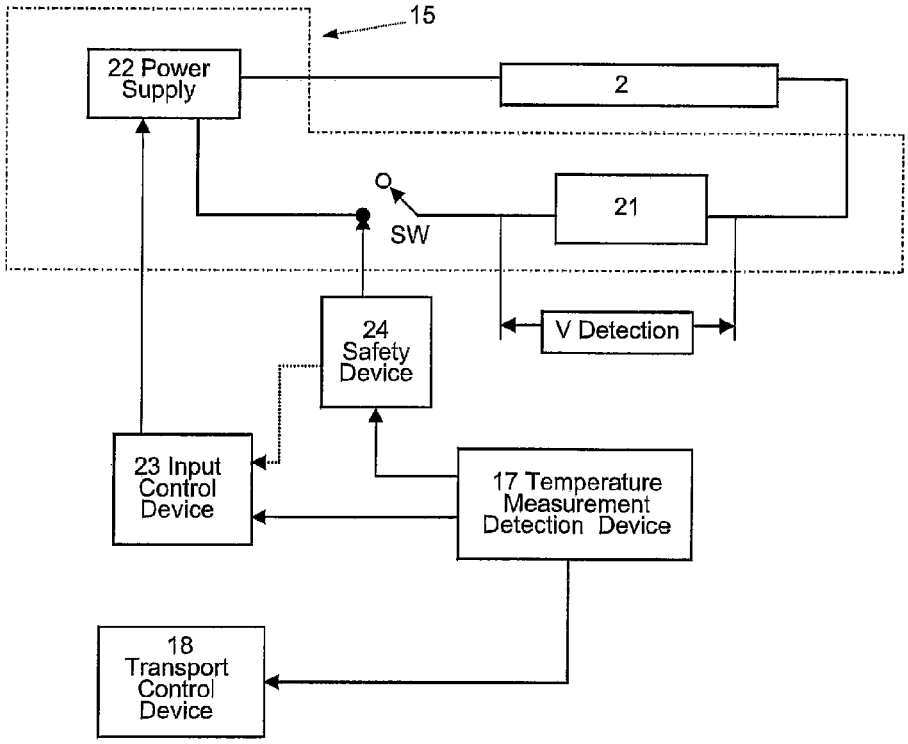
FIG. 8 is another example of block diagram for resistive element control means and the temperature measurement method shown on FIG. 3.

The Resistive Element Control Device 15, as shown on FIGS. 7 and 8, has the Power Supplies 32 and 22 which supply the direct current or pulse current to the Heating Resistive Element 2 and the Temperature Measurement Resistive Element 3 on the Ease Head 10. It also has the Switching Device SW for the Power Supplies 32 and 22 as well as the Voltage Divider Resistors 31 and 21. The Resistive Element Control Device 15 is connected to the Temperature Measurement Detection Devices 16 and Heating Temperature Detecting Device 17 which can detect the temperature of the Resistive Elements 3 and 2 respectively. Additionally, the Temperature Input Control Device 23 in order to maintain the Heating Resistive Element 2 constant and the Safety Device 24 are included. Also, the Resistive Element Control Device 15 can have the card detection sensor, event though it is not shown on the figure, which can turn the power to the Heating Resistive Element 2 and Temperature Measurement Resistive Element 3 off when the Card RC passing of the Erase Head 10 is detected if the sensor is installed. Even if the sensor is not available, the power can be turned off after predetermined time from the start of transporting as described before.

The Temperature Measurement Detection Device 16 to measure the Temperature Measurement Resistive Element 3 is connected to the Power Supply 32 for the direct current or pulsed voltage through the Voltage Divider Resistor 31 which is attached to the Temperature Measurement Resistive Element 3 in series as shown on FIG. 7. The material with the highest temperature coefficient available (such as 1000 to 3500 ppm/° C.) is used for the Temperature Measurement Resistive Element 3 as discussed previously. Since the purpose of the Temperature Measurement Resistive Element 3 is to detect the temperature of the head substrate surface, it is not desirable for the Temperature Measurement Resistive Element 3 itself to generate heat and raise the temperature. For that reason, it is desired to make the resistance value of the Temperature Measurement Resistive Element 3 low while making the resistance value of the Voltage Divider Resistor 31 high and temperature coefficient low. The Voltage Divider Resistor 31 should be placed away from the head substrate to reduce the effect of the environmental temperature changes. Practically, the power supply can be the direct current of 5 V, the Temperature Measurement Resistive Element 3 resistance value 13 Ohms and the Voltage Divider 31 resistance value 150 Ohms.

The Temperature Measurement Detection Device 16 is configured to find the temperature of the Temperature Measurement Resistive Element 3 at a given time by measuring the voltage across the Temperature Measurement Resistive Element 3 (V Detection) and calculating the temperature change by finding the voltage change. The Temperature Measurement Resistive Element 3 has the temperature coefficient which the resistance value changes at a constant rate according to the temperature and the coefficient is known (it is determined by the material, but actual measurement can give the precise value). As discussed before, the Temperature Measurement Resistive Element 3 and the Voltage Divider Resistor 31 are connected in series to the Power Supply 32. When the temperature of the Temperature Measurement Resistive Element 3 changes while a constant voltage is applied, the current will change as the resistance changes. Since the resistance value of the Voltage Divider Resistor 31 does not change, the voltage across the Temperature Measurement Resistive Element 3 changes according to its resistance change. The resistance value of the Temperature Measurement Resistive Element 3 can be found from the voltage change and the temperature at that moment can be figured out from the temperature coefficient.

The voltage across the Temperature Measurement Resistive Element (V Detection) is measured because the bigger the ratio of voltage change according to the temperature, the more accurate the detection is, but the voltage measurement across the Voltage Divider Resistor 31 can be used to detect the temperature change also.

The Heating Temperature Detecting Device 17 which measures the temperature of Heating Resistive Element 2 has a similar configuration as shown on FIG. 8. The Heating Resistive Element 2 and Voltage Divider Resistor 21 are connected in series. The Power Supply 22 is attached to supply the direct current or pulse voltage to detect the voltage across the Voltage Divider Resistor 21 (V Detection). In this case, the resistance of the Heating Resistive Element 2 is far higher than the Voltage Divider Resistor 21 because heating the Element 2 is the purpose of the configuration. For example, the resistance of the Heating Resistive Element 2 is 8 Ohms while the Voltage Divider Resistor is 0.22 Ohms (small value is used to minimize the power consumption even at the high current) and the applied voltage is higher value of 24 V. The voltage measurement (V Detection) is done at the smaller resistance side which is the Voltage Divider Resistor 21, but the voltage measurement can be made across the Heating Resistive Element 2 also.

The temperature of the Heating Resistance Element 2 can be controlled to within the predetermined temperature range by reducing the voltage of the Power Supply 22 through the temperature detection of the Input Control Device 23 or lowering the duty if the duty drive is used to cut back the input power in case the heating resistive element temperature goes up too high due to operation such as continuous usage. If there is a situation when complete erasing can not be achieved with the temperature measurement of the Temperature Measurement Resistive Element 3 alone because the temperature relationship between the head substrate surface and the Heating Resistive Element 2 due to operation such as continuous usage, it is possible to start driving the transporting device after the both temperatures reaches the predetermined level by sending the Heating Resistive Element 2 temperature measurement information to the Transport Control Device 18. The actual temperature measurement can be done similar way to the detection method used for the Temperature Measurement Resistive Element 2.

The Safety Device 24 is shown on FIG. 8 as an example which turns off the Switch SW of the Power Supply 22 immediately or issues a command to the Input Control Device 23 to reduce the input drastically if the measurement by the Heating Temperature Measuring Device 17 shows that it is above the predetermined level such as 30° C. over the erasing temperature of 130° C., for instance. Fire hazard and erase head destruction due to over-heating can be prevented by shutting off the Power Supply 22 or reducing the input drastically by having a means such as the Safety Device 24, even if the time control period of 2.5 seconds is not reached in the event that the temperature goes up extremely high because of such reasons as the power is turned on without having the card in place. So safety is assured in case there are anomalies in card transporting or heating element as the immediate control of input is possible regardless the waiting time in time control sequence.

Obviously, even if the temperature goes up higher than the predetermined level (130° C. in the previous example) because a card is not inserted, the regular control by the Input Control Device 23 is sufficient unless it goes beyond the pre-set high temperature (30° C. in the previous example) above the normal level (160° C., for example). This temperature can be set according to the allowable temperature of the equipment which uses the erase head (slightly lower than the guaranteed temperature on the specifications—allowable temperature minus required temperature).

Although the Safety Device 24 and Input Control Device 23 are shown separately in FIG. 8, the Safety Device 24 can be incorporated in the Input Control Device 23. In that case, it will act as the safety device by reducing the input substantially from the usual level or making it to zero if the temperature detected by the Heating Temperature Measurement Device 17 is higher than the predetermined temperature.

The Transport Control Device 18 turns on and off the Transport Device 13. It stops the Transport Device 13 based on:

The information from the aforementioned Temperature Measurement Device 16 that the temperature measurement resistive element reached the predetermined level.

The information from the heating and temperature measurement devices, Devices 16 and 17, that the resistive elements have reached predetermined temperatures respectively.

The information that the Card RC reached the Discharge Slot 14 by driving the transport device.

The predetermined time from the starting of transporting.

The operation of the erasing equipment is the next explanation. The power to Heating Resistive Element 2 and Temperature Measurement Resistive Element 3 is applied when the Card RC is inserted into the Insertion Slot 12 and the detection information is sent to the Resistive Element Control Device 15. The temperatures of Temperature Measurement Resistive Element 3 and Heating Resistive Element 2 are detected by the Temperature Measurement Device 16 and 17 respectively when the power is applied. When the temperature of the Temperature Measurement Resistive Element 3 detected by the Temperature Measurement Detection Device 18 reaches the predetermined level, the information is sent to the Transport Control Device 18 and the Transport Device 13 (13*a*, 13*b* and 13*c*) starts. As a result, the Card RC inserted into the Insertion Slot 12 is transported by the Rollers 13*a* and 13*b* to be sandwiched between the Erase Head 10 and the Platen Roller 10*a*. Since the temperature of the heating resistive element on the Erase Head 10 is at the predetermined level, the Card RC passing over the Erase Head 10 is brought up to the erasing temperature and de-colors. When the signal of the de-colored Card RC passes over the Erase Head 10 is sent to the Resistive Element Control Device 15 by the sensor or through time control, the power to the Resistive Element 2 and 3 is turned off. The Transport Device 13 is turned off when the information of the Card RC reaching the Discharge Slot 14 from the sensor or the time control is sent to the Transport Control Device 18.

One card erasing process completes as shown above, and then the same process is repeated when the next card needs to be erased. FIG. 6 is the relational timing chart of the resistive elements and transport device when 2 cards are processed consecutively.

The distinguishing character of this invention is to move the Card RC to the Erase Head 10 when the temperature of the temperature measurement resistive element (temperature of the head substrate surface) reaches the predetermined level. Erasing can be achieved if the temperature of the heating resistive element which the re-writable card is in contact is at the predetermined level in principle. However, as discussed previously, there seems to have irregular erasing streaks in the several cards when the beginning of the erasing process. It was found through the inventor's thorough investigation that this is caused due to the temperature reduction of the heating resistive element which is small by the card which is generally larger than 5 cm by 8 cm with various thicknesses. He found that the necessary temperature can be maintained even if the card is in contact when the surface temperature of the head substrate is reached at the predetermined level as certain amount of heat capacity can be reserved.

FIG. 9 shows the example of the temperature change of various parts against the time from the power is turned on. It may appear that there is no problem in erasing even if the small amount of heat is taken up when the predetermined temperature of heating resistive element is set high since the Temperature Change D of the heating resistive element and Temperature Change C of the head substrate surface are at almost parallel relationship. However, when there is a difference between the starting (t=0) temperature of the heating resistive element and surface temperature of head substrate, the temperature change against time becomes different. For that reason, a problem of inadequate erasing occurs due to the substrate temperature being too high as the temperature reduction is small even if the card is in contact with it when the predetermined level is set too high and it is hot after continuous operation. Also, it will take about 15 seconds from the starting of power on to erasing process like existing erasing heads if the heat capacity of the heating resistive element vicinity is made larger or the erasing process has to wait until the back side of the head substrate to reach the predetermined temperature which is not suitable for the on-demand operation that requires the power to be on when it is needed and power to be off when it is not necessary.

On the other hand, complete erasing is possible as enough heat capacity is secured so that the temperature of the heating resistive element will not go down quickly even if the card becomes in contact when the surface temperature of the head substrate is at the predetermined level as the inventor investigated. For example, while it takes 2.5 seconds as shown on FIG. 9 to reach the Heating Resistive Element (D) predetermined temperature of 150° C. and the Head Substrate Surface (C) temperature of 120° C., a stable erasing is possible. This is achieved with the new idea to control the erase head by the surface temperature of the head substrate and to provide the Thermal Resistive Layer 4 on the Heat Sink 5 as shown on FIG. 1. FIG. 9 shows the temperature change of the Heat Sink (A), Card (B), Head Substrate Surface (C) and Heating Resistive Element (D) with the heating resistive element having the resistive value of 7.77 Ohms and width of 2.5 mm, card transport speed of 30 mm/sec and the card being in contact with the erase head. The Card (B) is the temperature change measured by the inferred thermometer at 4.5 mm (location after 0.15 seconds) from the heating element. The head substrate surface temperature change without inserting the card and no load heating condition is shown as (E). The line (F) shows the temperature change of the heating resistive element with no load heating condition.

The change of time to reach the predetermined level due to difference of starting temperature can be observed as the time for the second card (t2) is shorter than first card (t1) on FIG. 6 which shows the time (t) between the resistive element power is turned on to the card movement from the insertion slot for the two cards erased consecutively. This means that the head substrate temperature is getting up with the first card erasing operation and the head substrate surface temperature reaches the predetermined level quicker and the erasing process can be done with shorter time when the second card is inserted and the power is turned on. So, it takes about 2.5 seconds and the complete erasing process is about 5 seconds even if it is after a long period of off time, yet over-heating will not occur even if the process continues for a long time. This is believed to be because the head substrate on the erase head is attached to the heat sink of high thermal conductivity through the specific thermal resistive layer. This makes it possible to reach the predetermined level in a short time due to a certain amount of blocking action by the thermal conduction, while the heat will escape to the heat sink for long term operation.

The example described above, the Transport Device 13 is driven by the Temperature Measurement Detection Device 16 only. This is because the temperature of the heating resistive element makes the head substrate temperature to go up in a regular operation starting. For example, when the temperature measurement resistive element goes up to 120° C., the temperature of the heating resistive element will raise to about 150° C. So, there will be no problem turning the transport device on when the temperature goes up to the predetermined by using only the temperature measurement resistive element when it is operated on demand and sporadically. However, when the head substrate temperature is substantially high due to continued operation, there is a case of time delay for the heating resistive element to get to 150° C. It will be safer to send the information of the heating resistive element to the transport control device as well and to start the transport device when both are at the predetermined level if this type of situation exists.

The next is the explanation of this invention's second implementation figuration of the heating head, re-writable media erasing device and its erasing method. The heating head related to the second implementation figuration is shown on FIG. 10 where the top view is (a) and the front view is (b). The Head Substrate 101 is flat and rectangular. The Main Heating Resistive Element 102 is formed on the surface of the Head Substrate 101 in lengthwise at least one strip. Additionally, the Temperature Measurement Resistive Element 103 and the Auxiliary Heating Resistive Element 107 are placed on the surface of the Head Substrate 101; both are near by the Main Heating Resistive Element 102. The Head Substrate 101 is held on to the Heat Sink 105 on the other side (back side) of the Head Substrate 101. The Thermal Resistive Layer 104 is in between the Head Substrate 101 and the Heat Sink 105.

The Head Substrate 101 can be similar to what is used for the first implementation figuration. The length of the Head Substrate 101 can be 2 inches or 4 to 8 inches according to the needs. The width is desirable to be about 10 mm for the longer case such as 8 inches.

The Main Heating Resistive Element 102 is formed by applying the paste-like mixture of substances such as Silver (Ag), Palladium (Pd) and solid insulation like glass in powder form onto the substrate and fired in the furnace. Additionally, such material as RuO2 can be added in the process. The sheet resistance for the fired Ag—Pd alloy is 100 mOhms/Sq to 200 mOhms/Sq (it changes based on the amount of solid insulation powder), but the resistance value and temperature coefficient can be changed with the mixture rate of the two. When it is used as the conductor (electrode), the resistance can be lowered with more Ag. The size is, for example, width about 2.5 mm and thickness about 10 micrometers. The length is about 45 mm on the Substrate 101 in the widthwise with linear shape and both ends are overlapping on the pair of electrodes (not shown as they are hidden under the Coupling Section 108). Resistance value is about 8 Ohms and resistor temperature coefficient is about 1500 ppm/° C. (i.e. when the temperature changes 100° C., then the resistance value changes 15%). The heating characteristics of the Heating Resistive Element 102 can be changed to any values, but it is desirable for this application to have high positive value, especially the material which gives 1000 to 3500 ppm/° C. is easier to control.

Positive and higher resistor temperature coefficient gives larger resistance value increase for the temperature rise which makes the detection of actual heating temperature easier and more accurate by measuring the resistance deviation of heated state from the standard resistance value. This makes the correction to the desired temperature easier by adjusting the applied voltage or duty cycle of applied pulse if needed. The positive resistor temperature coefficient prevents excessive heating by malfunctions such as thermal runaway as the resistance goes up as the temperature increases. When the resistance increases, the current decreases and the saturation temperature is reached faster which results in superior temperature stability at higher temperature. The width of the Heating Resistive Element 102 is not limited to the aforementioned example and it can be set up according to the application. Several of them can be placed in parallel.

Both ends of the Heating Resistive Element 102 are made into the electrodes, though not shown on the figure, by screen printing the good conductor, for example, silver-palladium alloy with reduced palladium ratio or Ag—Pt alloy. The electrodes are connected to the external connecting terminals on the wiring board which is not shown, but located side of the heat sink, through the intermediary conductors and the power is applied to the Heating Resistive Element 102.

The Auxiliary Heating Resistive Element 107 is made of same material as the Main Heating Resistive Element 102, placed in parallel with the Main Heating Element 102, spaced so that the gap between them is about 0.3 to 0.7 mm and formed the same length as the Main Heating Resistive Element 102 of 45 mm. The Auxiliary Heating Resistive Element 107 width is about 0.5 mm which is about ⅕ of the Main Heating Resistive Element 102. Therefore, the resistance becomes about 5 times of the Main Heating Resistive Element and the consumption power becomes only 20% if the same voltage (such as 24 V) is applied. It contributes, therefore, about 20% of the Main Heating Resistive Element 102 to the total heating. However, the ratio of heating of Auxiliary Heating Resistive Element 107 to the Main Heating Resistive Element 102 is not limited to 20% and it can be set freely. FIG. 10 shows the Auxiliary Heating Resistive Element 107 as one strip, but it does not have to be limited to one and multiple strips can be placed in such locations as the both side of the Main Heating Resistive Element 102. Also, as it will be discussed later, the auxiliary heating resistive element itself can be divided, not just to be divided by the electrodes.

The Temperature Measurement Resistive Element 103 can be made of the same material as the Heating Resistive Element 102, but it is desirable to have the highest absolute value (%) of temperature coefficient possible. The Temperature Measurement Resistive Element 103 is for measuring the temperature of Head Substrate 101 and not for heating. It is about 0.5 mm wide and 45 mm long with 12 Ohms, and the applied voltage is about 5 V so that it does not generate heat. Since the Temperature Measurement Resistive Element 103 is a thin layer on the Head Substrate 101, their temperatures are about the same. Therefore, the surface temperature of the Head Substrate 101 can be estimated by measuring the temperature of the Temperature Measurement Resistive Element 103. The larger temperature coefficient will make the measurement error smaller as the temperature is measured by detecting the voltage change across the Temperature Measurement Resistive Element 103. The temperature coefficient can be positive or negative for this application.

If the material of the Temperature Measurement Resistive Element 103 and the Heating Resistive Element 102 is the same, they can be manufactured at the same time if they are formed with method like screen-printing and it will be desirable. If higher temperature measurement accuracy is required, however, material with different mixture ratio of Ag and Pd or completely different material with larger temperature coefficient can be used.

The Main Heating Resistive Element 102, Auxiliary Heating Resistive Element 107 and Temperature Measurement Resistive Element 103 are not placed on the Head Substrate 101 directly in general. Instead, the Glass Layer 101*a* is made with double or triple screen-printing and then the resistive element materials are screened as shown in FIG. 11 of Expanded drawing. Though not shown, a protective layer made of such material as glass is put on the surface to prevent the abrasion and short-circuit due to adhesion of foreign object. The Glass Layer 101*a* is about 100 micron thick and the cross-section is trapezoidal (not limited to a complete trapezoid, but the "mountain-shape") as shown on FIG. 11. By placing the Auxiliary Heating Resistive Element 107 and the Temperature Measurement Resistive Element 103 on the slope side, the re-writable media contact becomes the Main Heating Resistive Element 102 part only which makes the media insertion smoother. Also, the Temperature Measurement Resistive Element 103 will not be affect by the media which is desirable.

The dimensions of FIG. 11 are Glass Layer 101*a* thickness about 100 microns, each resistive element thickness 10 to 20 microns, the over-coat (not shown) thickness 10 to 20 microns, Main Heating Resistive Element 102 width w12.5 mm, Auxiliary Heating Resistive Element 107 and Temperature Measurement Resistive Element 103 width w20.5 mm and their gap 0.3 to 0.7 mm. The Head Substrate 101 width w3 is 5 to 10 mm. The glass layer's thermal conductivity is 1 W/m·K.

The back side of Head Substrate 101 is attached to the Heat Sink 105 with Thermal Resistive Layer 104 sandwiched. The Thermal Resistive Layer 104, having lower thermal conductivity coefficient than the Head Substrate 101, helps to reach to the erasing temperature as soon as the Heating Resistive Element 102 on the Head Substrate 101 is energized by not leaking the heat generated. As discussed previously, there is a case when erasing is inadequate when the Head Substrate 101 is too low even if the Heating Resistive Element 102 is at the predetermined temperature. It was found by the inventor that temperature relationship between Heating Resistive Element 102 and Head Substrate 101 can be maintained by establishing the Thermal Resistive Layer 104 and controlling the thermal conductivity. The Thermal Resistive Layer 104 should have lower thermal conductivity than the Head Substrate, i.e. less than 0.3 W/m·K, and 0.5 mm thick glass-epoxy board (thermal conductivity: 0.2 W/m·K), for example, can be used. The material and thickness for the Thermal Resistive Layer 104 should be selected so that the temperature relationship between the Heating Resistive Element 102 and the surface temperature of the Head Substrate 101 becomes stable at the shortest time, yet they cool off as fast as possible when the power to the resistive element is turned off.

The Heat Sink 105 can be similar to what is used for the first implementation figuration. The side of the Heat Sink 105 has the wiring board such as a printed circuit board though it is not shown. The circuit wiring is covered with the insulation layer with the resin coating and the connection to the external power supply is made with the electrodes of the Main Heating Resistive Element 102, Auxiliary Heating Resistive Element 107 and the Temperature Measurement Resistive Element 103 through the Connecting Section 108 and the Connector 109. Also, it is not shown, but there may be a case when a thermistor is attached on the back side of the Substrate 105 for over-heating protection redundant safety measures.

FIG. 10's example discussed previously is to make the electrodes on both ends of the Auxiliary Heating Resistive Element 107 and Temperature Measurement Resistive Element 103 for measuring the average of the total length and heating as an auxiliary means. However, the Auxiliary Heating Resistive Element 107 and Temperature Measurement Resistive Element can be divided into 2 or more sections in order to measure temperature of the Main Heating Resistive Element 102 lengthwise in section. The auxiliary heating resistive element can be turned on based on the low temperature to make the temperature of total head more even. The dividing is accomplished by forming the electrode where the division is made as the Temperature Measurement Resistive Element 103 and Auxiliary Heating Resistive Element 107 are continuous lengthwise.

Figure 12:
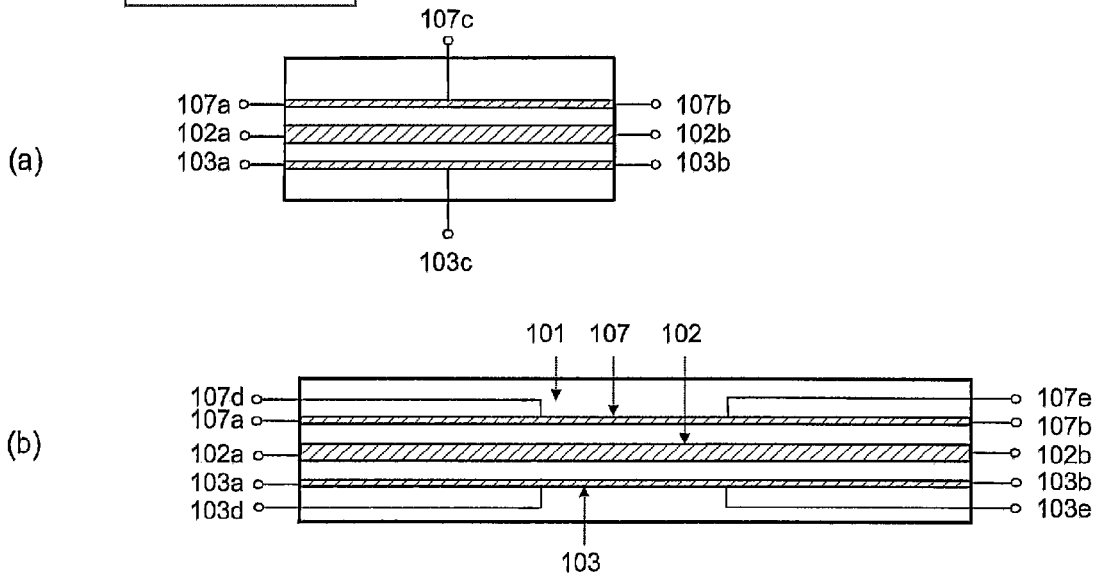
FIG. 12 is the top view which shows the third implementation figuration of the heating head of this invention.

FIG. 12 (*a*) shows the Temperature Measurement Resistive Element 103 and Auxiliary Heating Resistive Element 107 having the electrodes on both ends as 103*a*, 103*b*, 107*a* and 107*b* as well as the electrodes 103*c* and 107*c* respectively which can measure and heat half of the lengths. In other words, the total average temperature of the Temperature Measurement Resistive Element 103 can be measured if the power is applied to end electrodes of 103*a* and 103*b* while the left half of the average temperature can be measured if the power is applied between electrodes 103*a* and 103*c*. The right side half of average temperature measurement is done with the power on electrodes 103*b* and 103*c*. Similarly, the required location of the Auxiliary Heating Resistive Element 107 can be heated by selecting the electrodes 107*a*, 107*b* and 107*c*.

FIG. 12 (*b*) is an example of dividing the Temperature Measurement Resistive Element 103 and Auxiliary Heating Resistive Element 107 into 3 sections. Two electrodes 103*d* and 103*e* are made as the Temperature Measurement Resistive Element 103 is divided into 3 (the electrodes are lead to the Terminal Connection Section 108 on the Head Substrate 101), and the Auxiliary Heating Resistive Element 107 has similarly 2 electrodes 107*d* and 107*e* besides the end electrodes of 107*a* and 107*b* as a result of 3-part division. The temperature measurement and compensation of desired section can be accomplished by selective usage of those electrodes. For example, in FIG. 12 (*b*), the left one third of average temperature can be measured with the electrodes 103*a* and 103*b*. The left ⅔ region temperature measurement with the electrodes 103*a* and 103*e*, the middle in the third parts with electrodes 103*d* and 103*e*, the right ⅓ with electrodes 103*b* and 103 can be accomplished respectively. Similarly, the desired location of the Auxiliary Heating Resistive Element 107 can be heated by selecting the electrodes 107*a*, 107*b*, 107*d* and 107*e*.

By forming the electrode where the division is, the temperature of desired region can be measured and heated even if the division is more than 3, The Temperature Measurement Resistive Element 103 has high resistance value so that it will not contribute to temperature increase and making an electrode in the middle of Electrode 103 causes no problem. However, there will be a temperature reduction where an electrode is made in a middle point. But the Auxiliary Resistive Element only assists heating as the 90% of heat comes from the Main Heating Resistive Element 102 and unevenness of temperature of the Auxiliary Heating Resistive Element 103 will not have much effect. Since making an electrode in the middle of Main Heating Resistive Element 102 will cause the temperature variance in lengthwise, it is not practiced in order to keep the heating even. Temperature variation compensation can be achieved by making the Auxiliary Heating Resistive Element 107 instead of the electrode on the main heating element.

Figure 13:
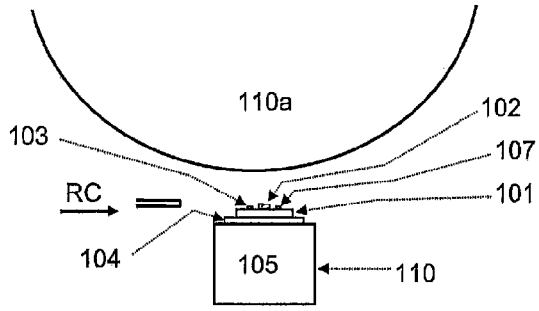
FIG. 13 is an approximate explanation diagram when the heating head shown in FIG. 10 is used for erasing.

FIG. 13 is an example of a heating head being used as the erase head for re-writable media erasing. The Main Heating Resistive Element 102 on the Erase Head 110 and the Platen Roller 110*a* are contacting each other. When the heating element reaches the predetermined temperature, the re-writable Card RC is moved over the heating element as the Platen Roller 110*a* rotates. While the card is passing the Main Heating Element 102, the card's image recording part is heated and the image is erased. In this case, the Card RC insertion can be done smoothly as the glass layer under the resistive element (not shown on FIG. 13) is made in trapezoidal shape.

The invented heating head can raise the temperature rapidly or compensate the temperature when it goes down while in use there is a Main Heating Resistive Element 102 as well as the Auxiliary Heating Resistive Element 107. The regional temperature measurement and compensation of temperature variation are possible by creating electrodes to divide the Temperature Measurement Resistive Element 103 and Auxiliary Heating Resistive Element 107 in lengthwise as shown FIG. 12. As a result, a wide A4 size (8-inch size) heating head for thermal transfer application which is prone to cause the temperature distribution variation can be compensated easily to make the temperature distribution even.

Moreover, it makes keeping the temperature to the re-writable media constant easier as the temperature compensation can be made by Auxiliary Heating Resistive Element 107 according to the measured temperature by the Temperature Measurement Resistive Element 103 while the Main Heating Resistive Element 102 can be held constant and without changing the input to the Element 102. The material the Head Substrate 101 is made of has a certain amount of thermal conductivity, while the back side is attached to the heat sink which has the thermal conductivity ten times higher than the head substrate and the Thermal Resistive Layer 104 in between the two has the thermal conductivity which is 1/100 of the head substrate. Since the heat sink which is in contact with the thermal resistive layer has a very good thermal conductivity, heat is dissipated through the thin thermal resistive layer when the head is used continuously for a long time. As a result, the temperature goes up to the predetermined level in a short time while it does not over-heat even if the unit is used continuously. Therefore, this makes an extremely thermally stable heating head under any usage conditions for re-writable media erasing device which may be used intermittently and for heating head for thermal transfer unit of under-coating and over-coating.

Figure 14:
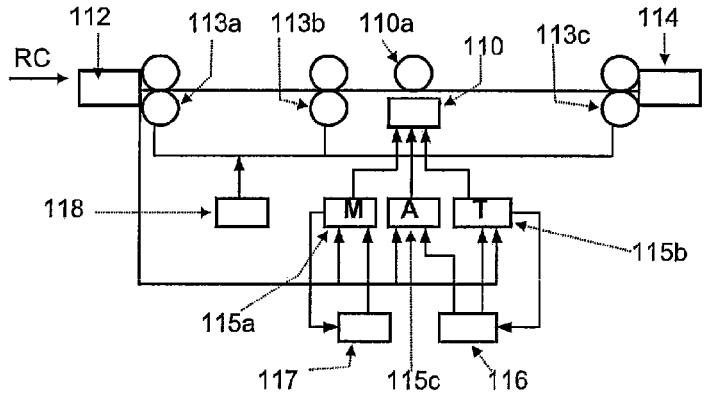
FIG. 14 is an outline block diagram of the erasing equipment by this invention equipped with the heating head configuration shown on FIG. 10.

The next is the explanation of the re-writable media easing device which uses the invented erase head described previously as the second implementation figuration and its erasing method. FIG. 14 is the block diagram of an example of the erasing device for the re-writable media by this invention. The characteristics of erasing method is to use the Erase Head 110 whose configuration is shown on FIG. 10 and to detect the temperature of the measurement resistive element, i.e. head substrate surface temperature. When the temperature reaches the predetermined level, then the re-writable media card RC is transported onto the heating resistive element for erasing. Also, the other characteristic is that the Auxiliary Heating Resistive Element 107 is established. Quick operation is possible even for on-demand request by using the auxiliary heating element while heating to get up to the predetermined temperature in very short time. Once the temperature reaches the predetermined level, maintenance of desired temperature becomes easier by turning off or on the Auxiliary Heating Resistive Element 107.

Figure 15:
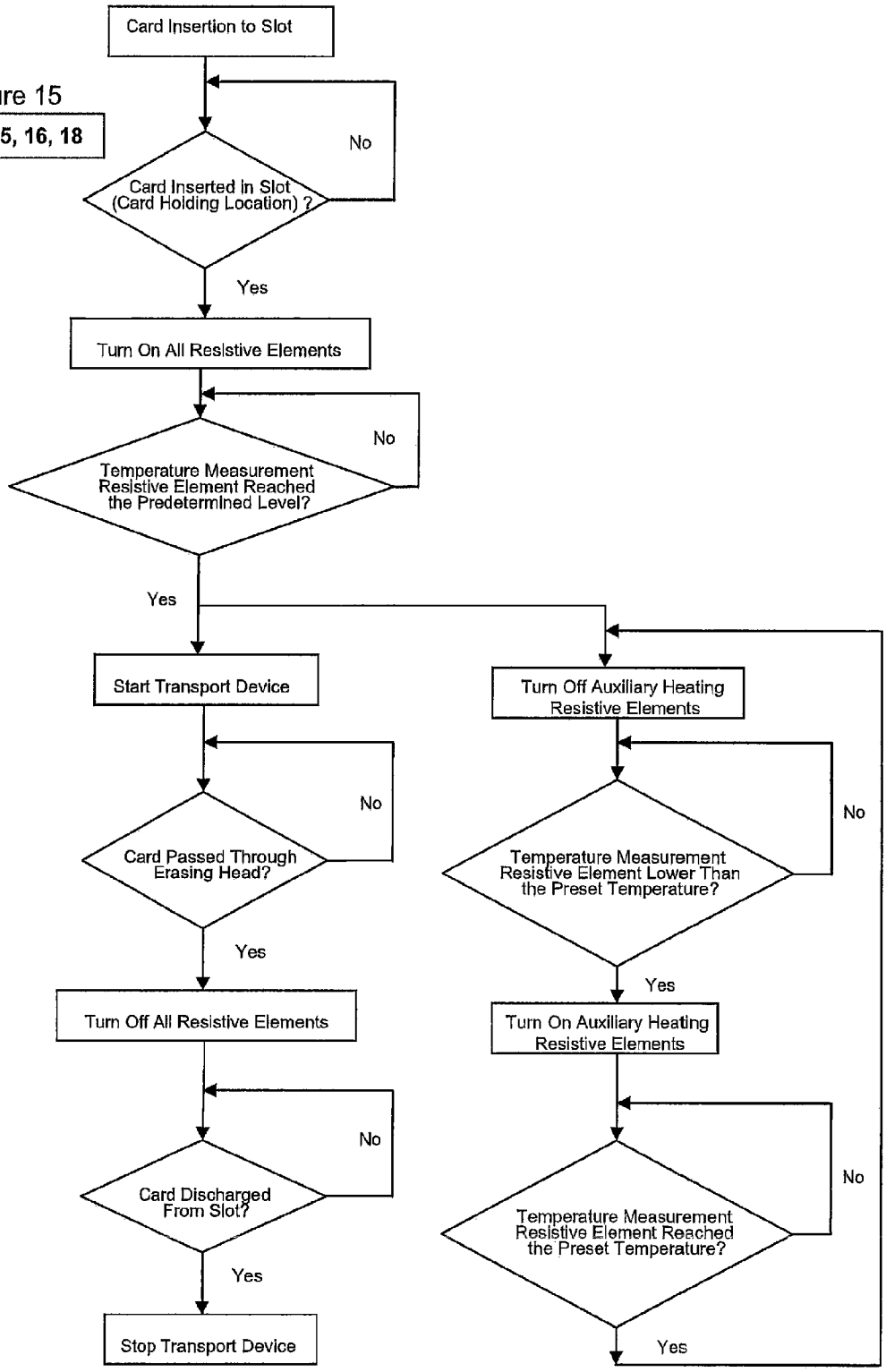
FIG. 15 is the flow chart of implementation of erasing method by this invention using the heating head configuration shown on FIG. 10.

Specifically, the flow chart is shown on FIG. 15. When the Card RC is inserted to the media holding location, Insertion Slot 112 of the erasing device, for example, the power to the main heating resistive element, temperature measurement resistive element and auxiliary heating resistive element is turned on by the Resistive Element Control Devices 115*a* through 115*c*. When the Temperature Measurement Device 116 detects the temperature reaching the predetermined level (130° C. for example), the Card RC is moved by the Transport Device 113 (113*a*, 113*b* and 113*c*) with the Transport Control Device 118. Simultaneously, the Auxiliary Heating Resistive Element is turned off. The power to the heating resistive element and temperature measurement resistive element is turned off when the Card RC goes on and through the Erase Head 110. While the operation is in progress, the auxiliary heating resistive element is turned on if the temperature measurement resistive element goes below the predetermined level to recover the temperature. Once the temperature is at the predetermined level again, then the auxiliary element is turned off. This repeats until the process is completed.

When the Card RC is discharged from the Discharge Slot 114 of the erase device, the Transport Device 113 is halted by the Transport Control Device 118 through detection sensor (not shown) or time control from the transport starting time. The timing chart of the Resistive Element Control Devices 115*a* and 115*b* and Transport Control Device 118 is shown on FIG. 6. FIG. 6 shows the example of two cards processed in succession.

The speed of Transport Device 113 is about 30 mm/sec for example, but it can be increased or decreased based on the application. The control of transport device can be done with preset time interval rather than controlling by the card position. For example, the resistive elements power can be turned off after 2.5 seconds (movement of 75 mm) from starting signal by the Temperature Measurement Device 16 to transport device and the transport device can be stopped after 3 seconds (movement of 90 mm) once the transport speed is recognized. The time can be set based on the size of the equipment and the media holding location.

The example on FIG. 15 is based on the media holding location being at the card insertion slot, but it can be at the various places within the erasing device such as near or in the touching distance from the erasing head. In this case, the power-on is controlled to the aforementioned resistive elements after the card is sent to the media holding location automatically or manually when the card is inserted to the slot.

The block diagram shown in FIG. 14 is constituted so that a series of processes shown in FIG. 15 can be performed. The Insertion Slot 112 is made so that the Card RC can be inserted and it acts as the media holding location where the card insertion sensor is placed (although it is not shown). The signal from the sensor when the card is inserted is sent to the Resistive Element Control Devices 115*a*, 115*b* and 115*c* which control the Main Heating Resistive Element 102, Temperature Measurement Resistive Element 103 and Auxiliary Heating Resistive Element 107 respectively. The inserted Card RC is transported via Transport Device 113 while the Card RC is sandwiched with the Transport Rollers 113*a*, 113*b* and 113*c* to the Erase Head 110 and the Discharge Slot 114. The rotation of the Transport Rollers 113*a*, 113*b* and 113*c* is controlled by the Transport Control Device 118 and the Card RC is transported according to the predetermined timing. The FIG. 14 shows the Insertion Slot 112 and Discharge Slot 114 are in a separate location, but the Insertion Slot 112 and Discharge Slot 114 can be at the same place by reversing the Card RC's direction during the process. Also, as stated before, the media holding location can be set up in a different place from the Insertion Slot 112.

Figure 16:
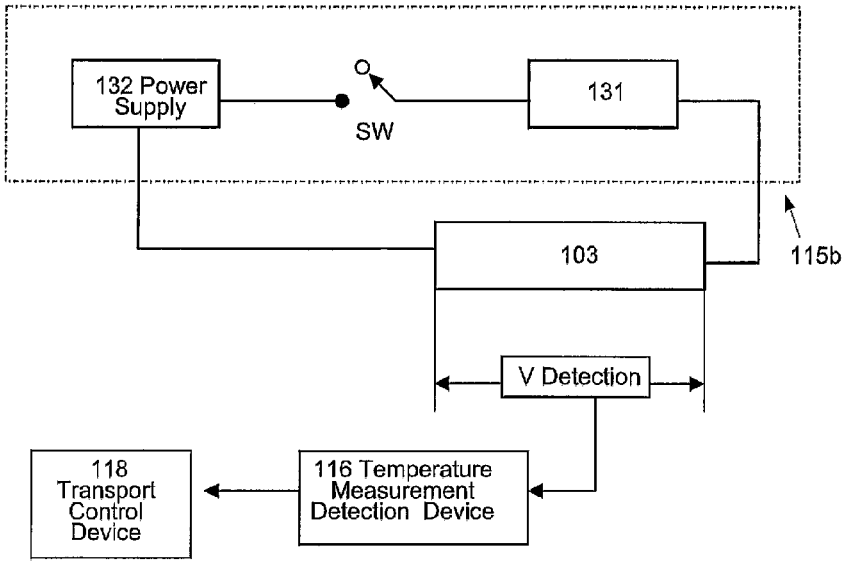
FIG. 16 is an example of block diagram for resistive element control means and the temperature measurement method shown on FIG. 14.
Figure 17:
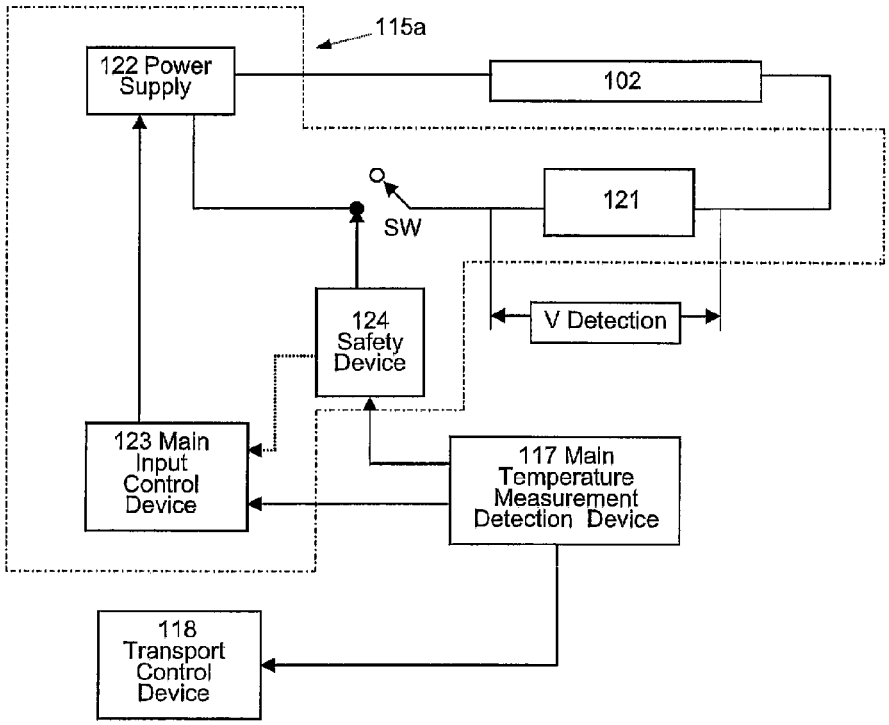
FIG. 17 is another example of block diagram for resistive element control means and the temperature measurement method shown on FIG. 14.

The Resistive Element Control Device 115 a which control the Main Heating Resistive Element 102, as shown on FIG. 17, has the Power Supply 122 which supplies the direct current or pulse current to the Main Heating Resistive Element 102 on the Erase Head 110, Switch Device SW, Voltage Divider Resistor 121, Input Control Device for Main 123 and Safety Device 124. The Resistor Element Control Device 115*b* for the Temperature Measurement Resistive Element 103 is shown on FIG. 16 and it is equipped with the Power Supply 132 which supplies the direct current, pulse current or alternate current to the Temperature Measurement Resistive Element 103, Switch Device SW, and Voltage Divider Resistor 131. The Resistor Element Control Device 115*c* for the Auxiliary Heating Resistive Element 107 is shown on FIG. 18 and that has the Power Supply 173 which supplies the direct current, pulse current or alternate current to the Auxiliary Heating Resistive Element 107. The Resistive Element Control Devices 115*b* and 115*a* for the Temperature Measurement Resistive Element 103 and Main Heating Resistive Element 102 are connected to the Temperature Measurement Detection Device 116 and Main Heating Temperature Detection Device 117 for the Resistors 103 and 102. The Input Control Device for the Main Temperature 123 which keeps the temperature of the Main Heating Resistive Element 102 and the Safety Device 124 are also included in the Resistive Element Control Device 115*a*.

Also, one of the Resistive Element Control Devices 115*a* through 115*c* can be equipped with the card detection sensor, even though it is not shown on the figure, which can turn the power to the Heating Resistive Element 102 and Temperature Measurement Resistive Element 103 off when the Card RC passing of the Erase Head 110 is detected if the sensor is installed. Even if the sensor is not available, the power can be turned off after a predetermined time from the start of transporting as described before.

The Temperature Measurement Detection Device 116 to measure the Temperature Measurement Resistive Element 103 is connected to the Power Supply 132 for the direct current or pulsed voltage through the Voltage Divider Resistor 131 which is attached to the Temperature Measurement Resistive Element 103 in series as shown on FIG. 16. The material with the highest temperature coefficient available (such as 1000 to 3500 ppm/° C.) is used for the Temperature Measurement Resistive Element 103 as discussed previously. Since the purpose of the Temperature Measurement Resistive Element 103 is to detect the temperature of the head substrate surface, it is not desirable for the Temperature Measurement Resistive Element 103 itself to generate heat and raise the temperature. For that reason, it is desired to make the resistance value of the Temperature Measurement Resistive Element 103 low while making the resistance value of the Voltage Divider Resistor 131 high and temperature coefficient low. The Voltage Divider Resistor 31 should be placed away from the head substrate to reduce the effect of the environmental temperature changes. Practically, the power supply can be the direct current of 5 V, the Temperature Measurement Resistive Element 103 resistance value 12 Ohms and the Voltage Divider 131 resistance value 150 Ohms.

The Temperature Measurement Detection Device 116 is configured to find the temperature of the Temperature Measurement Resistive Element 103 at a given time by measuring the voltage across the Temperature Measurement Resistive Element 103 (V Detection) and calculating the temperature change by finding the voltage change. The Temperature Measurement Resistive Element 103 has the temperature coefficient which the resistance value changes at a constant rate according to the temperature and the coefficient is known (it is determined by the material, but actual measurement can give the precise value). As discussed before, the Temperature Measurement Resistive Element 103 and the Voltage Divider Resistor 131 are connected in series to the Power Supply 132. When the temperature of the Temperature Measurement Resistive Element 103 changes while a constant voltage is applied, the current will change as the resistance changes. Since the resistance value of the Voltage Divider Resistor 131 does not change, the voltage across the Temperature Measurement Resistive Element 103 changes according to its resistance change. The resistance value of the Temperature Measurement Resistive Element 103 can be found from the voltage change and the temperature at that moment can be figured out from the temperature coefficient.

The voltage across the Temperature Measurement Resistive Element (V Detection) is measured because the bigger the ratio of voltage change according to the temperature, the more accurate the detection is, but the voltage measurement across the Voltage Divider Resistor 131 can be used to detect the temperature change also.

The Main Heating Temperature Detecting Device 117 which measures the temperature of Main Heating Resistive Element 102 has a similar configuration as shown on FIG. 17. The Main Heating Resistive Element 102 and Voltage Divider Resistor 121 are connected in series. The Power Supply 122 is attached to supply the direct current or pulse voltage to detect the voltage across the Voltage Divider Resistor 121 (V Detection). In this case, the resistance of the Main Heating Resistive Element 102 is far higher than the Voltage Divider Resistor 121 because heating the Element 102 is the purpose of the configuration. For example, the resistance of the Main Heating Resistive Element 102 is 8 Ohms while the Voltage Divider Resistor is 0.22 Ohms (small value is used to minimize the power consumption even at the high current) and the applied voltage is higher value of 24 V. The voltage measurement (V Detection) is done at the smaller resistance side which is the Voltage Divider Resistor 121, but the voltage measurement can be made across the Main Heating Resistive Element 102 also.

The temperature of the Main Heating Resistance Element 102 can be controlled to within the predetermined temperature range by reducing the voltage of the Power Supply 122 through the temperature detection of the Input Control Device 123 for Main or lowering the duty if the duty drive is used to cut back the input power in case the Main Heating Resistive Element temperature goes up too high due to operation such as continuous usage. If there is a situation when complete erasing can not be achieved with the temperature measurement of the Temperature Measurement Resistive Element 103 alone because the temperature relationship between the head substrate surface and the Main Heating Resistive Element 102 due to operation such as continuous usage, it is possible to start driving the transporting device after both temperatures reaches the predetermined level by sending the Heating Resistive Element 2 temperature measurement information to the Transport Control Device 118. The actual temperature measurement can be done in a similar way to the detection method used for the Temperature Measurement Resistive Element 102.

The Safety Device 124 is shown on FIG. 17 as an example which turns off the Switch SW of the Power Supply 122 immediately or issues a command to the Input Control Device 123 for Main to reduce the input drastically if the measurement by the Main Heating Temperature Measuring Device 117 shows that it is above the predetermined level such as 30° C. over the erasing temperature of 130° C., for instance. Fire hazard and erase head destruction due to over-heating can be prevented by shutting off the Power Supply 122 or reducing the input drastically by having a means such as the Safety Device 124, even if the time control period of 2.5 seconds is not reached in the event that the temperature goes up extremely high because of such reasons as the power is turned on without having the card in place.

So safety is assured in case there are anomalies in card transporting or heating element as the immediate control of input is possible regardless the waiting time in time control sequence. Obviously, even if the temperature goes up higher than the predetermined level (130° C. in the previous example) because a card is not inserted, the regular control by the Input Control Device 123 for Main is sufficient unless it goes beyond the pre-set high temperature (30° C. in the previous example) above the normal level (160° C., for example). This temperature can be set according to the allowable temperature of the equipment which uses the erase head (slightly lower than the guaranteed temperature on the specifications—allowable temperature minus required temperature).

Although the Safety Device 124 and Input Control Device 123 for Main are shown separately in FIG. 17, the Safety Device 124 can be incorporated in the Main Input Control Device 123. In that case, it will act as the safety device by reducing the input substantially from the usual level or making it to zero if the temperature detected by the Main Heating Temperature Measurement Device 117 is higher than the predetermined temperature.

Figure 18:
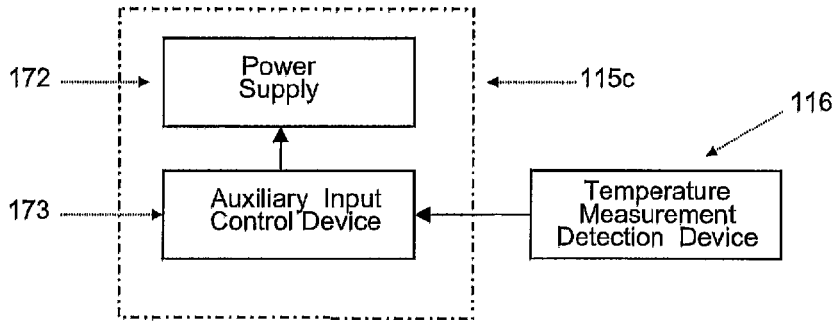
FIG. 18 is the block diagram of auxiliary heating resistive element control method shown on FIG. 14.
Figure 19:
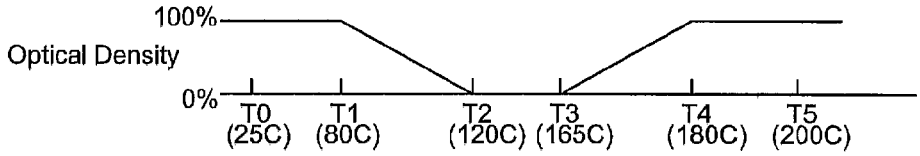
FIG. 19 is the diagram to show color and de-color temperature of the re-writable media.
Figure 20:
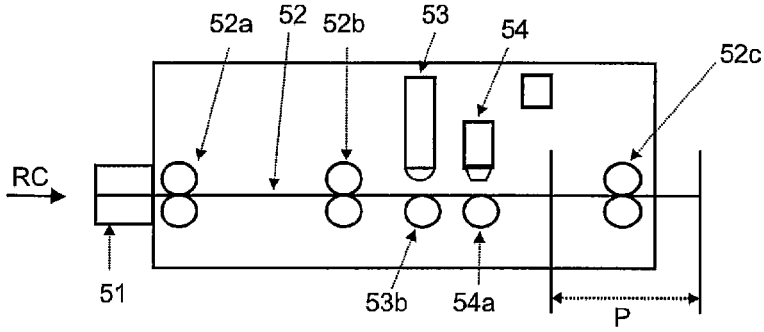
Figure 20 Prior Art
FIG. 20 is an example of existing re-writable card printer configuration.
Figure 21:
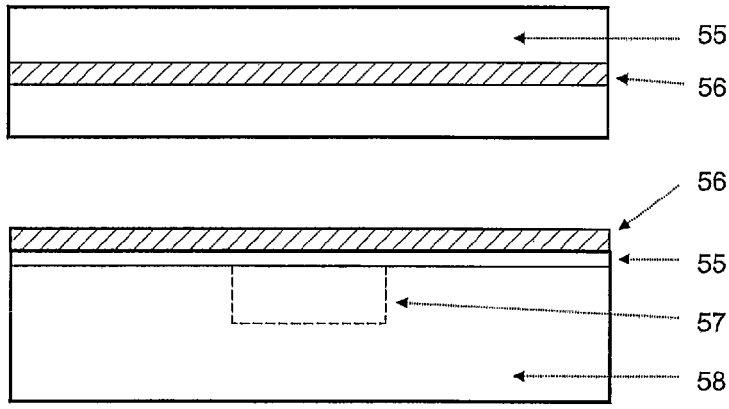
Figure 21 Prior Art
FIG. 21 is a block diagram of an example of existing erase head.

The Resistive Element Control Device 115*c* for the Auxiliary Heating Resistive Element 107 is shown in FIG. 18 and it consists of the Power Supply 172 which supplies the direct current, pulse current or alternate current which is connected to the Auxiliary Input Control Device 173. It is connected to the Auxiliary Heating Resistive Element 107 through its electrodes. This Auxiliary Input Control Device 173 is connected to the aforementioned Temperature Measurement Detection Device 116 and it can control the increase/decrease or on/off of the input. The auxiliary heating resistive element is turned on in the beginning when the re-writable media is erased, for example, along with the Main Heating Resistive Element 103 by applying the predefined input. When the temperature of the Temperature Measurement Resistive Element reaches the predetermined level, the input is controlled by turning off or reducing greatly. If the temperature of the Temperature Measurement Resistive Element goes down below the predetermined level, then the temperature is maintained by re-energizing the auxiliary heating resistive element. The control is accomplished by input increase/decrease or input turn on/off according to the temperature. The control of the auxiliary heating resistive element according to the temperature can maintain the desired temperature level without changing the input to the main heating resistive element as shown in FIG. 15 flowchart by repeated control through microprocessor.

In this case, the time to reach the predetermined temperature level will be shorter if input of the Main Heating Resistive Element 102 should be set to 90% and the Auxiliary Heating Resistive Element 107 to 20% of the regular input necessary for regular heating. Also, the temperature control will be easier. However, the ratio of input between the main heating resistive element and auxiliary heating resistive element is not limited to this example's value.

As shown previously, also, the configuration is such that controlling as a block or divided section is possible when the auxiliary heating resistive element and temperature measurement resistive element are both divided into multiple sections. Because the main heating resistive element draw heavy current, it is difficult to increase the starting input beyond its capability or fine-tune to the minor temperature compensation alone. On the other hand, the auxiliary heating resistive element's current is about ⅕ of the main element which makes the control easier. Also, it makes maintenance of temperature at a constant level simpler as there is no current change in the heating element which is in contact with the re-writable media which does not cause rapid temperature change.

The Transport Control Device 118 turns on and off the Transport Device 113. It stops the Transport Device 113 based on:

The information from the aforementioned Temperature Measurement Device 116 that the temperature measurement resistive element reached the predetermined level.

The information from the main heating and temperature measurement devices, Devices 116 and 171, that the resistive elements have reached predetermined temperatures respectively.

The information that the Card RC reached the Discharge Slot 114 by driving the transport device.

The predetermined time from the starting of transporting.

The operation of the erasing equipment is the next explanation. The power to Main Heating Resistive Element 102, Auxiliary Heating Resistive Element 107 and Temperature Measurement Resistive Element 103 is applied when the Card RC is inserted into the Insertion Slot 112 and the detection information is sent to the Resistive Element Control Devices 115*a* through 115*c*. The temperatures of the Temperature Measurement Resistive Element 103 and Main Heating Resistive Element 102 are detected by the Temperature Measurement Devices 116 and 117 respectively when the power is applied. When the temperature of the Temperature Measurement Resistive Element 103 detected by the Temperature Measurement Detection Device 118 reaches the predetermined level, the information is sent to the Transport Control Device 18 and the Transport Device 113 (113*a*, 113*b* and 113*c*) starts. As a result, the Card RC inserted into the Insertion Slot 112 is transported by the Rollers 113*a* and 113*b* to be sandwiched between the Erase Head 110 and the Platen Roller 110*a*. When the Transport Device 113 is engaged, the input to the Auxiliary Heating Resistive Element 107 can be reduced or turned off. Since the temperature of the main heating resistive element on the Erase Head 110 is at the predetermined level, the Card RC passing over the Erase Head 110 is brought up to the erasing temperature and decolors. When the signal of the de-colored Card RC passes over the Erase Head 110 is sent to the Resistive Element Control Device 115 by the sensor or through time control, the power to the Resistive Element 102 and 103 is turned off. The Transport Device 113 is turned off when the information of the Card RC reaching the Discharge Slot 114 from the sensor or the time control is sent to the Transport Control Device 118.

One card erasing process completes as shown above, and then the same process is repeated when the next card needs to be erased. FIG. 6 is the relational timing chart of the resistive elements and transport device when 2 cards are processed consecutively.

The distinguishing character of this invention is to move the Card RC to the Erase Head 110 when the temperature of the temperature measurement resistive element (temperature of the head substrate surface) reaches the predetermined level and also to provide the Auxiliary Heating Resistive Element 107 in addition to the Main Heating Resistive Element 102 and to control the temperature of the Main Heating Resistive Element 102 by the Auxiliary Heating Resistive Element 107. That is to say, it may be possible to maintain the constant temperature by adjusting the input of the Main Heating Resistive Element 102, but it is likely to have the temperature variation in time as the temperature swings drastically. However, the time-wise stability is achieved by keeping the Main Heating Resistive Element at 90% of the input constant and making the temperature compensation with the input adjustment of Auxiliary Heating Resistive Element 107 if there is a change in temperature.

As a result, a very stable erasing is possible by controlling the main heating resistive element which is in contact with the re-writable media about constant temperature and without a significant temperature variation.

Additionally, the temperature distribution is made uniform length-wise even when the main heating resistive element becomes long and resistance value is not constant or the temperature is not uniform due to the reason of set layout, etc.

The example described above, the Transport Device 113 is driven by the Temperature Measurement Detection Device 116 only. This is because the temperature of the heating resistive element makes the head substrate temperature to go up in a regular operation starting. For example, when the temperature measurement resistive element goes up to 120° C., the temperature of the main heating resistive element will raise to about 150° C. So, there will be no problem turning the transport device on when the temperature goes up to the predetermined by using only the temperature measurement resistive element when it is operated on demand and sporadically. However, when the head substrate temperature is substantially high due to continued operation, there is a case of time delay for the heating resistive element to get to 150° C. It will be safer to send the information of the heating resistive element to the transport control device as well and to start the transport device when both are at the predetermined level if this type of situation exists.

The invention claimed is:

1. A heating head adapted to function as an erase head for use with re-writable media record equipment, said heating head comprises:

a head substrate;

a main heating element; and a temperature measurement element;

wherein said main heating element and said temperature measurement element are both on a first side of said head substrate, and wherein said temperature measurement element is located proximate said main heating element, said temperature measurement element being oriented substantially parallel to said main heating element and wherein said temperature measurement element is substantially the same length as said temperature measurement element.

2. The heating head of claim 1 wherein said main heating element and said temperature measurement element are each resistive elements comprising substantially the same material, and a first voltage applied to said temperature measurement element is substantially lower than a second voltage applied to said main heating element so that said temperature measurement element does not substantially generate heat while measuring a temperature of said head substrate.

3. The heating head of claim 2 wherein said temperature measurement element is divided into multiple sections so that temperature measurement can be made in multiple sections in lengthwise portions of said main heating element.

4. The heating head of claim 2 wherein said main heating element has a positive temperature coefficient which increases in electrical resistance by 1000-3500 ppm/° C. wherein the temperature of said main heating element is measured by connecting a resistor of smaller temperature coefficient than said main heating element in series with said main heating element.

5. The heating head of claim 2 wherein said temperature measurement element is coated onto said first side of said head substrate and has a positive or negative temperature coefficient of 1000-3500 ppm/° C. wherein said temperature measurement element and a resistor of smaller temperature coefficient than said temperature measurement element in series with said temperature measurement element.

6. The heating head of claim 1 further comprising an auxiliary heating element positioned along said first side of said head substrate.

7. The heating head of claim 6 further including a thermal insulation layer between said heat sink and said other side of said head substrate.

8. The heating head of claim 6 wherein said auxiliary heating element and said main temperature measurement element are positioned along said main heating element wherein electrodes formed on said auxiliary heating element and said temperature measurement element so that heating and/or temperature measurement can be made in multiple sections in lengthwise portions of said main resistive heating element.

9. The heating head of claim 6 wherein said main heating element, said auxiliary heating element and said temperature measurement element are formed onto a protection layer affixed to said head substrate;

said protection layer is formed to vary the thickness widthwise; and said main heating element is on a thick part of said protection layer while the auxiliary heating element and said temperature measurement element are on the thin part of said protection layer.

* * * * *